US010610076B2

(12) United States Patent
Chavana, Jr. et al.

(10) Patent No.: US 10,610,076 B2
(45) Date of Patent: Apr. 7, 2020

(54) LIQUID EXTRACTION APPARATUS

(71) Applicant: Rug Doctor, LLC, Plano, TX (US)

(72) Inventors: Ernest Matthew Chavana, Jr., Villa Ridge, MO (US); Richard Foster, Powell, OH (US); Stanley Anderson, Fenton, MO (US); Christopher Terpstra, Frisco, TX (US); Jan Valentic, Plano, TX (US)

(73) Assignee: RUG DOCTOR, LLC, Plano, TX (US)

( * ) Notice: Subject to any disclaimer, the term of this patent is extended or adjusted under 35 U.S.C. 154(b) by 196 days.

(21) Appl. No.: 15/631,875

(22) Filed: Jun. 23, 2017

(65) Prior Publication Data

US 2018/0368644 A1 Dec. 27, 2018

(51) Int. Cl.

| | |
|---|---|
| ***A47L 11/40*** | (2006.01) |
| ***A47L 11/34*** | (2006.01) |
| ***A47L 11/08*** | (2006.01) |

(52) U.S. Cl.

CPC ..... *A47L 11/4013* (2013.01); *A47L 11/085* (2013.01); *A47L 11/34* (2013.01); *A47L 11/4075* (2013.01); *A47L 11/4088* (2013.01)

(58) Field of Classification Search

CPC ..... A47L 11/4013; A47L 11/085; A47L 11/4016; A47L 11/4072; A47L 11/4075;

(Continued)

(56) References Cited

U.S. PATENT DOCUMENTS 6,167,586 B1 * 1/2001 Reed, Jr. ..... A47L 5/28 137/614.2
2005/0091783 A1 * 5/2005 Sepke ..... A47L 9/0483 15/320

(Continued)

FOREIGN PATENT DOCUMENTS

EP 2494899 A2 9/2012
JP 2000-217759 A 8/2000

(Continued)

OTHER PUBLICATIONS

Korean Office Action dated Jul. 26, 2019, in connection with Korean Patent Application No. 10-2018-0072037, citing the above reference.

(Continued)

*Primary Examiner* — Dung Van Nguyen
(74) *Attorney, Agent, or Firm* — Hauptman Ham, LLP

(57) ABSTRACT

An apparatus includes a body, a first tank and a second tank. The body includes a first fluid coupling and a first air passage. The first tank includes a first vessel configured to accommodate a fluid and a second fluid coupling communicatively coupled with the first fluid coupling. The second tank includes a second vessel separated from the first vessel and a second air passage communicatively coupled with the first air passage. The apparatus also includes a tank base over the body. The tank base includes a first tank seat configured to accommodate the first tank and a second tank seat configured to accommodate the second tank. The tank base is configured to be separated from the body with at least one of the first tank in the first tank seat or the second tank in the second tank seat.

20 Claims, 14 Drawing Sheets

(58) Field of Classification Search
CPC . A47L 11/408; A47L 11/4083; A47L 11/4088
See application file for complete search history.

(56) References Cited

U.S. PATENT DOCUMENTS

| | | | | |
|---|---|---|---|---|
| 2012/0066859 | A1* | 3/2012 | Louis | A47L 11/34 15/322 |
| 2012/0137464 | A1* | 6/2012 | Thatcher | A47L 11/302 15/320 |
| 2012/0304416 | A1* | 12/2012 | Nguyen | A47L 11/34 15/383 |
| 2013/0318741 | A1* | 12/2013 | Moyher, Jr. | A47L 5/362 15/327.1 |
| 2015/0245757 | A1* | 9/2015 | Wall | A47L 11/4088 15/321 |

FOREIGN PATENT DOCUMENTS

| | | | |
|---|---|---|---|
| JP | 2010-029600 | A | 2/2010 |
| KR | 10-2016-0015622 | A | 2/2016 |

OTHER PUBLICATIONS

European Search Report dated Jun. 7, 2019, in connection with European Patent Application No. 18 179160.9, citing the above reference.

Japanese Office Action dated Jun. 20, 2019 in connection with counterpart Japanese Patent Application No. 2018-118375, citing the above references.

Korean Notice of Allowance dated Nov. 29, 2019, in connection with the Korean Patent Application No. 10-2018-0072037.

Indian First Examination Report for corresponding Indian application No. 201844023387 dated Feb. 11, 2020.

* cited by examiner

LIQUID EXTRACTION APPARATUS

BACKGROUND

Device manufacturers and service providers are continually challenged to develop cleaning systems capable of providing value and convenience to consumers. Conventional floor cleaning systems are often intimidating to consumers and offer limited flexibility.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
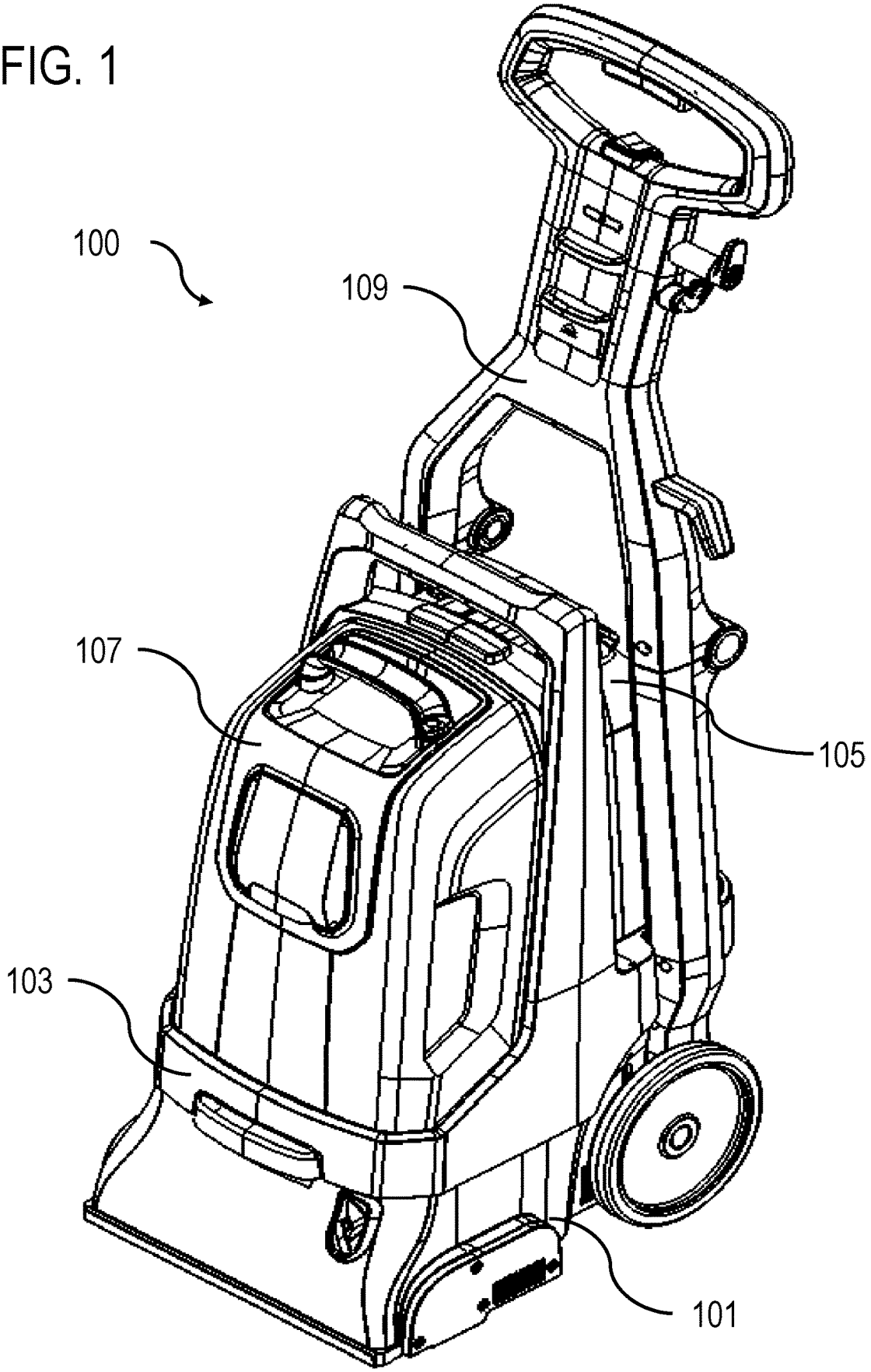
FIG. 1 is a perspective view of an apparatus, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the location of a first feature over or on a second feature in the description that follows may include embodiments in which the first and second features are in direct contact, and may also include embodiments in which additional features may be between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Conventional liquid extraction devices are often large, bulky, and otherwise intimidating cleaning systems that consumers usually have difficulty operating and handling. Conventional cleaning systems are often limited as to how the components of the cleaning system can be manipulated by a consumer, making transport and service difficult.

FIG. 1 is a perspective view of an apparatus 100, in accordance with some embodiments. Apparatus 100 comprises a body 101, a tank base 103, a cleaning fluid tank 105, a recovery tank 107, and a handle 109. Apparatus 100 is a liquid extraction cleaning system. In some embodiments, apparatus 100 is configured to clean a surface over which apparatus 100 is positioned. Apparatus 100 is shown in an assembled state.

Tank base 103 is over body 101. Each of cleaning fluid tank 105 and recovery tank 107 is inserted into tank base 103. In some embodiments, at least one of cleaning fluid tank 105 or recovery tank 107 is on tank base 103 such that the cleaning fluid tank 105 or the recovery tank 107 is supported by tank base 103 over body 101. In some embodiments, tank base 103 is configured to cooperate with at least one of cleaning fluid tank 105 or recovery tank 107 to removably secure cleaning fluid tank 105 or recovery tank 107 to the tank base 103.

Each of the cleaning fluid tank 105 and the recovery tank 107 is communicatively coupled with a corresponding portion of body 101. In some embodiments, tank base 103 is configured to facilitate the communicative coupling of the cleaning fluid tank 105 and the recovery tank 107 with body 101 through tank base 103.

In some embodiments, apparatus 100 is a modular system such that tank base 103 is configured to be removed from or placed over the assembled apparatus with or without one or both of the cleaning fluid tank 105 or the recovery tank 107 inserted into, on, or attached to tank base 103. In some embodiments, body 101 and tank base 103 are each configured to cooperate with one another to removably secure the tank base 103 to body 101.

Handle 109 is coupled with body 101. In some embodiments, handle 109 is rotatably coupled with body 101 such that handle 109 is capable of being in a substantially upright position with respect to body 101 or in another position between the substantially upright position with respect to body 101 and a surface over which body 101 is positioned.

In use, one or more components of body 101 are configured to cause fluid accommodated within cleaning fluid tank to be expelled onto a surface over which the body 101 is positioned, and to cause one or more of air, debris, a liquid or a portion of the fluid to be drawn from the surface over which the body 101 is positioned into the recovery tank 107.

The various embodiments discussed herein improve user confidence in the ability to one or more of operate, transport or operate a liquid extraction apparatus such as apparatus 100. For example, a modular configuration of the apparatus 100 makes transporting the apparatus 100 much easier for a user. The tank base 103 is capable of being separated from the body 101 with or without one or more of cleaning fluid tank 105 and recovery tank 107. Separating the tank base 103 from the body 101 splits an overall weight of apparatus 100 into at least a first portion comprising the body 101 and handle 109 and a second portion comprising the tank base 103, cleaning fluid tank 105 and recover tank 107, making lifting and maneuverability easier for a user. Additionally, tank base 103 makes it possible to carry the tank base 103, the cleaning fluid tank 105 and the recovery tank 107 together. Carrying the tank base 103, the cleaning fluid take 105 and the recovery tank 107 together makes using the apparatus 100 easier, because the body 101 is able to be left in one location, while the tank base 103 is configured to facilitate carrying of the cleaning fluid tank 105 and the recovery tank 107 to and from another location. In some embodiments, tank base 103 is configured to facilitate carrying of the cleaning fluid tank 105 and the recovery tank 107 to another location using one hand.

In some embodiments, because the overall weight of apparatus 100 is capable of being spit into at least two modular portions, the body 101 is capable of housing a larger vacuum motor to increase cleaning performance compared to conventional liquid extraction systems. For example, if a threshold weight for lifting a liquid extraction system is set for a conventional liquid extraction system, suction power is often limited, because increasing the size of the vacuum motor included in the liquid extraction system would usually be met with concerns that the liquid extraction system would be too heavy to lift. Conventional liquid extraction systems often compromise cleaning performance for portability. The severability of tank base 103 makes it possible to overcome the fear that increased suction comes at the cost of increased weight that would make lifting the apparatus 100 difficult for an ordinary user.

In some embodiments, body 101 has one or more panels that are capable of being removed for ease of access to the features housed therein. In some embodiments, removing the tank base 103 together with cleaning fluid tank 105 and recover tank 107 improves a user's ability to access the body 101 by making it possible to remove the tank base 103, the cleaning fluid tank 105 and the recover tank 107 from the body 101 in one operation, consolidating an amount of time a user needs to gain access to an upper portion of the body 101 that would otherwise be beneath the tank base 103.

In some embodiments, one or more sides of the body 101 comprise one or more quick-release panels to facilitate easy access for a user to service the apparatus 100. In some embodiments, at least one of the one or more quick-release panels is with another portion of body 101 by one or more fasteners. In some embodiments, the one or more fasteners are capable of being tightened and loosened using a conventional screwdriver, a flathead screwdriver, a Philips head screwdriver, a hex-head screw driver, a torx-head screw driver, or other suitable type of screwdriver head. In some embodiments, all of the quick-release panels that are coupled with the body 101 by a fastener are coupled by a same type of fastener to facilitate ease of access to the body 101 and the components housed therein.

Figure 2A:
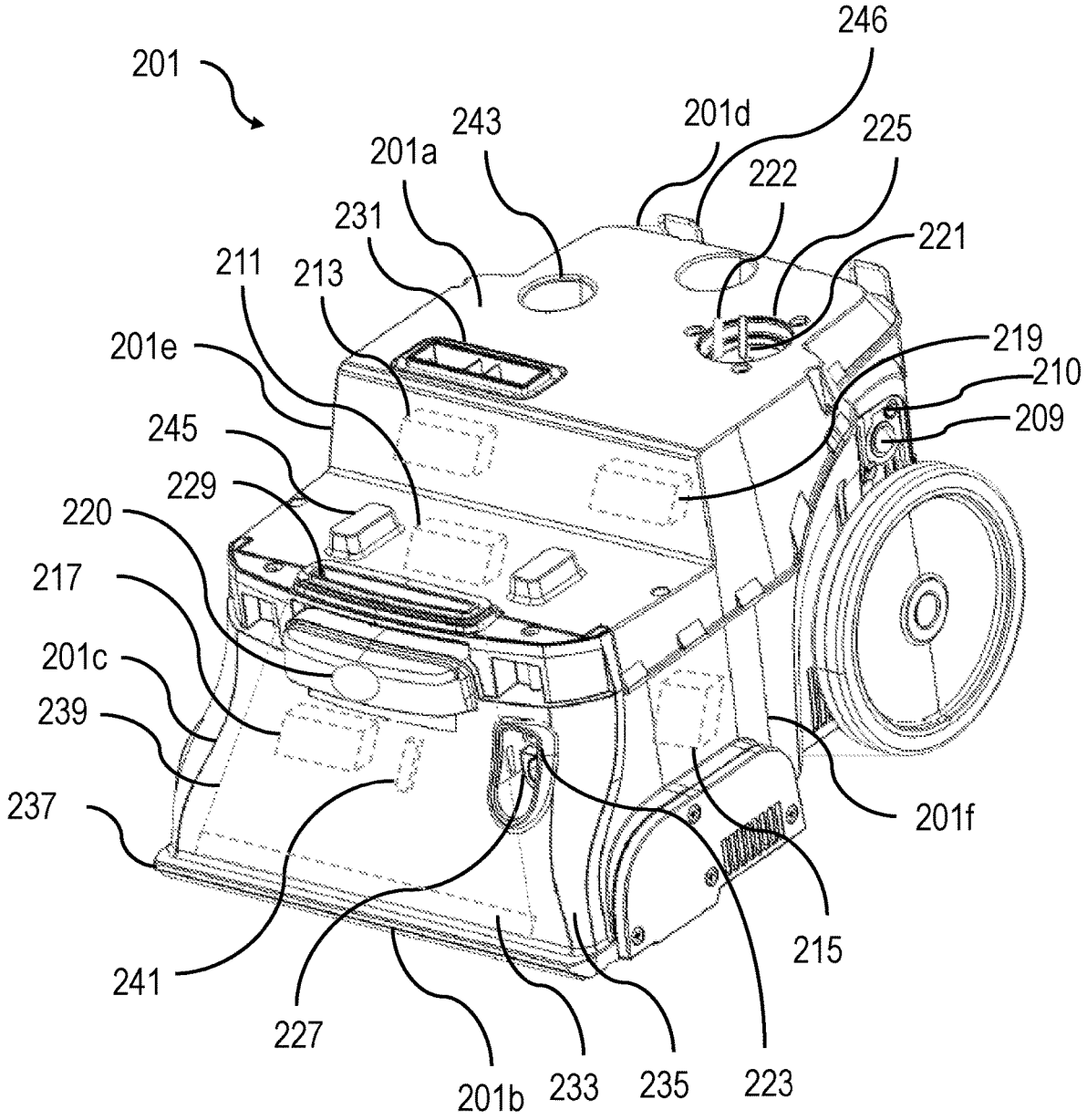
FIG. 2A is an upper-side perspective view of a body, in accordance with some embodiments.

FIG. 2A is an upper-side perspective view of a body 201, in accordance with some embodiments. Body 201 is usable as body 101 (FIG. 1) in apparatus 100 (FIG. 1). Body 201 has an upper side 201*a*, a lower side 201*b*, a front side 201*c*, a back side 201*d*, a left side 201*e* and a right side 201*f*. Body 201 comprises one or more sidewalls that define the upper side 201*a*, the lower side 201*b*, the front side 201*c*, the back side 201*d*, the left side 201*e* and the right side 201*f*, and at least one cavity therein.

Handle 109 (FIG. 1) is configured to be rotatably coupled with the body 201 about an axis 209. Body 201 includes a handle locking mechanism 210 configured secure the handle 109 in a substantially upright position with respect to body 201 in a locked-state. In some embodiments, handle locking mechanism 210 comprises a detent lock, pin, spring, ring or other suitable structure configured to mate with a slot or other suitable structure on handle 109 in the locked-state. In some embodiments, pulling on the handle 109 with at least a predetermined amount of force causes the handle 109 to be released from the locked-state with respect to body 201. In some embodiments, the handle locking mechanism 210 is configured to release the handle 109 from the locked-state if an end of the handle 109 is pulled in a direction away from body 201 by a force in a range of about 5 lbf to about 25 lbf. In some embodiments, locking mechanism 210 comprises a release switch, button, or other suitable device configured to release the handle 109 from the locked-state with respect to body 201. In some embodiments, locking mechanism 210 comprises a slot, or other suitable structure configured to mate with a corresponding structure on handle 109 to fix handle 109 in the locked-state.

In some embodiments, a controller 211 is housed inside the body 201. In some embodiments, the controller 211 is outside the body 201. In some embodiments, one or more of a vacuum motor 213 having an inlet and an outlet, an agitator motor 215, a fluid diverter 217 or a fluid pump 219 is one or more of on or housed within the cavity of body 201.

Figure 12:
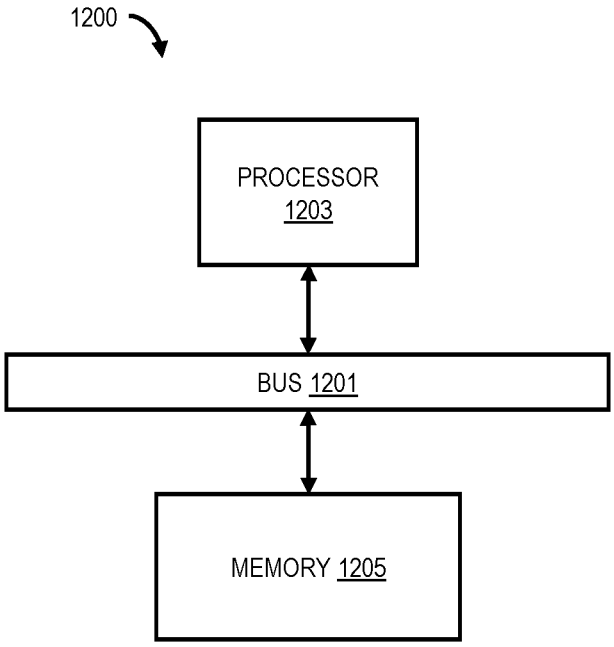
FIG. 12 is a functional block diagram of a computer or processor-based system upon which or by which an embodiment is implemented.

Controller 211 comprises a chipset having a processor and a memory (e.g., chipset 1200, FIG. 12). Controller 211 is communicatively coupled with one or more of the vacuum motor 213, the agitator motor 215, the fluid diverter 217 or the fluid pump 219. In some embodiments, the memory included in the controller 211 has computer executable instructions stored thereon that, when executed by the processor of controller 211, cause the vacuum motor 213 to turn on or off. In a default operative state, the vacuum motor 213 is configured to draw air into the inlet of the vacuum motor 213 and exhaust air from the outlet of the vacuum motor 213. In some embodiments, the controller 211 is configured to cause the vacuum motor 213 to run in reverse such that the vacuum motor 213 draws air into the outlet of the vacuum motor 213 and exhausts air from the inlet of the vacuum motor 213.

In some embodiments, body 201 comprises a headlight 220 communicatively coupled with the controller 211. If body 201 includes headlight 220, controller 211 is configured to cause the headlight 220 to be on or off based on an actuation of a system power switch, a light control switch, a fluid release or agitator control switch, or other suitable switch, or one or more of the controller 211, vacuum motor 213, agitator motor 215, or other suitable component of body 201 being turned on.

A tank electrical contact 221 is on the body 201 and communicatively coupled with the controller 211. The tank electrical contact 221 is accessible for coupling with the cleaning fluid tank 105 (FIG. 1). In some embodiments, the tank electrical contact 221 is on the upper side 201*a* of the body 201. In some embodiments, the tank electrical contact 221 is on a different side of the body 201. In some embodiments, tank electrical contact 221 comprises a pin or other suitable structure configured to mate with a portion of cleaning fluid tank 105 to cause a cleaning fluid contained within the cleaning fluid tank 105 to flow out of the cleaning fluid tank 105. In some embodiments, the body 201 includes a second tank electrical contact 222 that is separated from tank electrical contact 221. One or more of tank electrical contact 221 or second tank electrical contact 222 comprises a metal, a semiconductor, a non-metallic conductor, or some other suitable electrically conductive material. In some embodiments, tank electrical contact 221 and second tank electrical contact 222 comprise a same material or combination of materials. In some embodiments, tank electrical contact 221 and second tank electrical contact 222 comprise a different material or a different combination of materials.

An accessory electrical contact 223 is on the body 201 and communicatively coupled with the controller 211. The accessory electrical contact 223 is accessible for electrically coupling an accessory attachment to the apparatus 100. In some embodiments, the accessory electrical contact 223 is on the front side 201*c* of the body 201. In some embodiments, the accessory electrical contact 223 is on a different side of the body 201. Accessory electrical contact 223 comprises a metal, a semiconductor, a non-metallic conductor, or some other suitable electrically conductive material.

A tank fluid coupling 225 is on the body 201. The tank fluid coupling 225 is accessible for coupling with the cleaning fluid tank 105. The tank fluid coupling 225 is on the upper side 201*a* of the body 201. In some embodiments, the tank fluid coupling 225 is on a different side of the body 201. Tank fluid coupling 225 comprises a cup-shaped receptacle within which a fluid coupling of cleaning fluid tank 105 is configured to be placed upon assembly. In some embodiments, tank electrical contact 221 projects upward from a bottom surface of tank fluid coupling 225 such that the tank electrical contact 221 is capable of mating with the fluid coupling of tank 105. In some embodiments, second tank electrical contact 222 projects upward from the bottom surface of the tank fluid coupling 225 and extends to a height that is less than a height of the tank electrical contact 221 with respect to the bottom surface of tank fluid coupling 225 such that the second tank electrical coupling 222 is configured to be outside an area of the fluid coupling of tank 105 with which the tank electrical contact 221 is configured to mate. In some embodiments, controller 211 is configured to determine a quantity of cleaning fluid in the cleaning fluid tank 105 based on a capacitance in the cleaning fluid tank 105 or in the tank fluid coupling 225 detected using one or more of the tank electrical contact 221 or the second tank electrical contact 222. In some embodiments, the controller 211 is configured to determine the cleaning fluid tank 105 is empty based on a determination that an electrical connection between tank electrical contact 221 and second tank electrical contact 222, made by way of cleaning fluid in the space between tank electrical contact 221 and second tank electrical contact 222, is broken.

An accessory fluid coupling 227 is on the body 201. The accessory fluid coupling 227 is accessible for making a fluid coupling between the accessory attachment and the apparatus 100. The accessory fluid coupling 227 is on the front side 201*c* of the body 201. In some embodiments, the accessory fluid coupling 227 is on a different side of the body 201. The accessory fluid coupling 227 is communicatively coupled with the tank fluid coupling 225 by way of a fluid flow path extending from the tank fluid coupling 225 to the accessory fluid coupling 227.

The body 201 has a first air passage 229 on the upper side 201*a* of the body 201 configured to be communicatively coupled with the recovery tank 107 (FIG. 1), a second air passage 231 on the upper side 201*a* of the body 201 communicatively coupled with an inlet of the vacuum motor 213 and configured to be communicatively coupled with the recovery tank 107, and a third air passage 233 on the lower side 201*b* of the body 201 communicatively coupled with the first air passage 229.

The body 201 includes a nozzle 235 on the front side 201*c* of the body 201. The nozzle 235 comprises a skid portion 237 and a nozzle flow path 239 communicatively coupling the third air passage 233 with the first air passage 229. In some embodiments, nozzle 235 comprises a front sidewall that is configured to be separable from one or more other portions of the body 201. In some embodiments, the nozzle flow path 239 is configured to be separable from one or more of the front sidewall of the nozzle 235 or the one or more other portions of the body 201. In some embodiments, the nozzle flow path 239 is defined by the front sidewall of the nozzle 235, a sidewall of the body 201 between the front sidewall of the nozzle 235 and the components housed within the cavity of the body 201, and one or more other sidewalls of one or more of the nozzle 235 or the body 201 between the front sidewall of the nozzle 235 and the sidewall of the body 201, defining a gap through which one or more of air, liquid or debris is able flow from the third air passage 233 to the first air passage 229.

In some embodiments, the skid portion 237 is separable from the nozzle 235. In some embodiments, the skid portion 237 comprises the third air passage 233. In some embodiments, the skid portion 237 is a single piece that is integrally formed with the nozzle flow path 239. In some embodiments, the skid portion 237 comprises one or more of a metal, a polymer, or some other suitable material. In some embodiments, the skid portion 237 comprises a tapered shape facing the front side 201*c* of the body 201. In some embodiments, skid portion 237 has a slot defined therein that is communicatively coupled with the third air passage 233.

A fluid output 241 is on the body 201. Fluid output 241 comprises a jet, a spray nozzle, or some other suitable structure through which a fluid is capable of being expelled. The fluid output 241 is communicatively coupled with the tank fluid coupling 225 by way of a fluid flow path extending from the tank fluid coupling 225 to the fluid output 241. The fluid output 241 is configured to output cleaning fluid received from cleaning fluid tank 105 to facilitate distribution of a cleaning fluid stored in cleaning fluid tank 105 onto a surface external to the body 201. In some embodiments, the fluid output 241 is configured to output cleaning fluid received from cleaning fluid tank 105 onto a surface over which body 201 is positioned. In some embodiments, fluid output 241 is configured to output cleaning fluid received from cleaning fluid tank 105 directly onto a surface over which body 201 is positioned. In some embodiments, fluid output 241 is configured to output cleaning fluid received from cleaning fluid tank 105 such that the cleaning fluid is directed to an intermediary component of body 201 or a surface of body 201 such that at least a portion of the cleaning fluid is indirectly output onto a surface over which body 201 is positioned.

The fluid diverter 217 is coupled with the tank fluid coupling 225, the fluid output 241 and the accessory fluid coupling 227 such that the fluid diverter 217 is between the tank fluid coupling 225, the fluid output 241 and the accessory fluid coupling 227. The fluid diverter 217 is a valve configured to enable cleaning fluid accommodated in cleaning fluid tank 105 to flow from cleaning fluid tank 105 to one or more of the fluid output 241 or the accessory fluid coupling 227. In some embodiments, the fluid diverter 217 is configured to enable cleaning fluid accommodated in cleaning fluid tank 105 to flow from cleaning fluid tank 105 to only of the fluid output 241 or the accessory fluid coupling 227. In some embodiments, the fluid diverter 217 is a solenoid valve or other suitable structure capable of facilitating fluid flow from the tank fluid coupling 225 to the fluid output 241 by way of a first flow path or fluid flow from the tank fluid coupling to the accessory fluid coupling by way of a second flow path. In some embodiments, fluid diverter 217 is communicatively coupled with controller 211. Controller 211 is configured to cause the fluid diverter 217 to divert flow the fluid output 241 and/or the accessory fluid coupling 227.

The top side 201*a* of the body 201 includes at least one cleaning fluid tank alignment guide 243. In some embodiments, the cleaning fluid tank alignment guide 243 is a concave structure within the top side 201*a* of body 201. In some embodiments, the cleaning fluid tank 105 comprises a body coupling configured to extend into the tank flow path 225 such that the tank electrical coupling 221 is inserted into the body fluid coupling of cleaning fluid tank 105. In some embodiments, if the cleaning fluid tank 105 is configured having a body coupling configured to extend into the tank flow path 225, the tank 105 includes one or more supports to prevent the cleaning fluid tank 105 from tipping if the cleaning fluid tank 105 is stood upright away from the body 201. In such an embodiment, the one or more cleaning tank alignment guides 243 are configured to accommodate the one or more supports included on the cleaning fluid tank 105.

In some embodiments, the top side 201*a* of body 201 is free from including the at least one cleaning fluid tank alignment guide 243. In some embodiments, the top side 201*a* of body 201 includes at least one cleaning fluid tank alignment guide 243 that is convex and configured to mate with a concave portion of cleaning fluid tank 105.

The top side 201*a* of body 201 includes at least one recovery tank alignment guide 245. The at least one recovery tank alignment guide 245 is convex with respect to the top side 201*a* of body 201. The at least one recovery tank alignment guide 245 is configured to mate with a concave portion of recovery tank 107 to aid in the communicative coupling between the first air passage 229 and the recovery tank 107. In some embodiments, the top side 201*a* of body 201 is free from including the at least one recovery tank alignment guide 245. In some embodiments, the top side 201*a* of body 201 includes at least one recovery tank alignment guide 245 that is concave and configured to mate with a convex portion of recovery tank 107.

Body 201 comprises a locking mechanism 246 configured to secure the tank base 103 (FIG. 1) to body 201. In some embodiments, the locking mechanism 246 is buckle, latch, hook, or other suitable fastener configured to removably secure the tank base 103 to the body 201. In some embodiments, body 201 is free from including locking mechanism 246, and instead includes one or more pins, nubs, hooks, or some other suitable structure configured to mate with the tank base 103 to removably secure the tank base 103 to the upper side 201*a* of body 201.

Figure 2B:
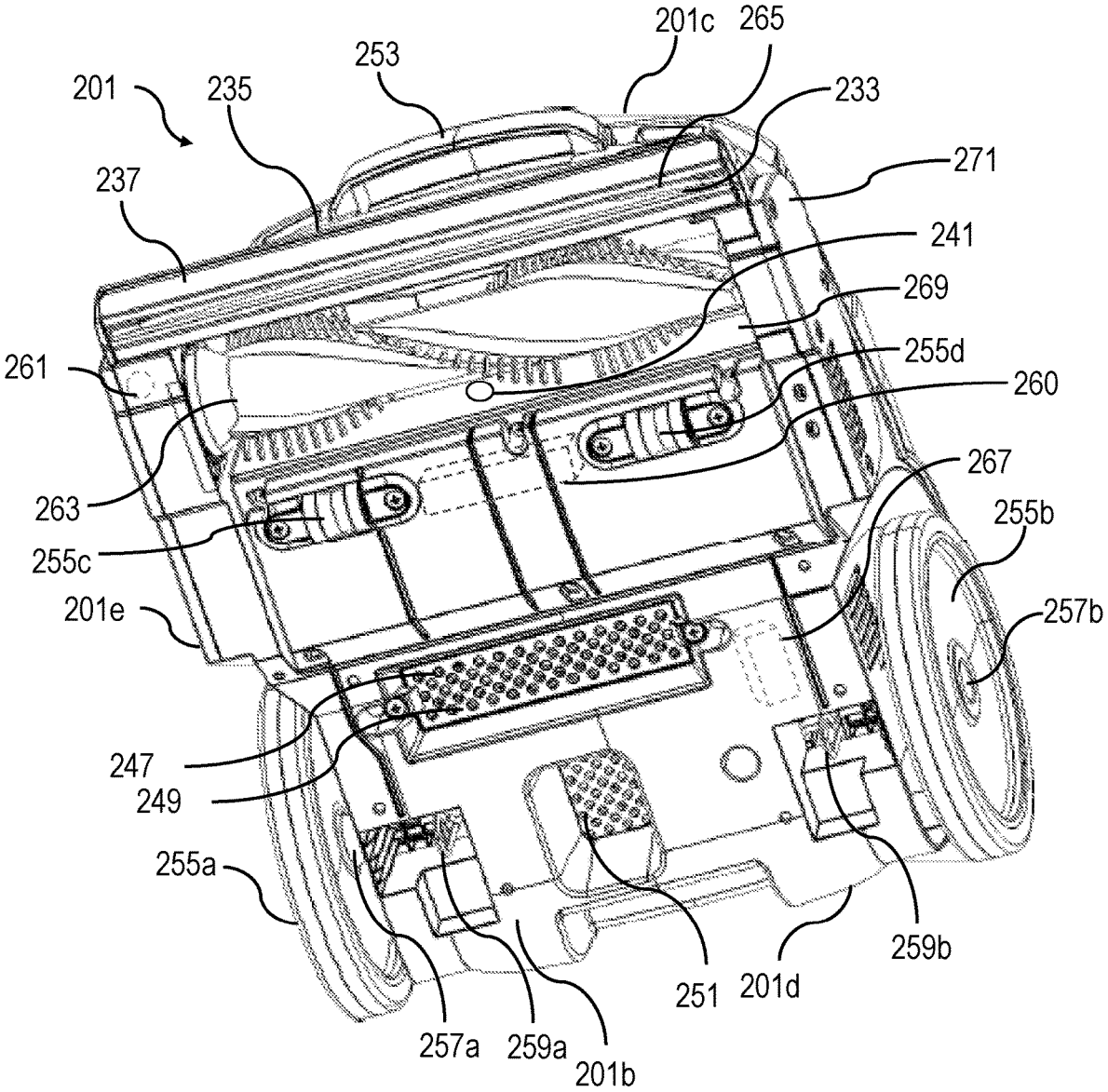
FIG. 2B is a lower-side perspective view of the body, in accordance with some embodiments.

FIG. 2B is a lower-side perspective view of the body 201, in accordance with some embodiments.

Body 201 includes a fourth air passage 247 on the lower side 201*b* of the body 201 communicatively coupled with the outlet of the vacuum motor 213. The fourth air passage 247 is configured to cause air exhausted by the vacuum motor 213 to blow onto a surface beneath the body 201. In some embodiments, the fourth air passage 247 is covered with a grate 249 configured to cause air exhausted by the vacuum motor 213 flow out of the fourth air passage 247 in a predetermined direction toward the surface beneath the body 201 or to effect a turbulent flow of the air from the fourth air passage 247 to increase a drying effect on the surface beneath the body 201. In some embodiments, the body 201 comprises a cavity vent 251 communicatively coupled with the cavity inside the body 201. The cavity vent 251 is configured to dissipate heat from the cavity inside the body 201 toward a surface beneath the body 201.

Body 201 includes a carry handle 253 on the front side 201*c* of the body 201. In some embodiments, carry handle 253 attached to, or a component of, the nozzle 235. In some embodiments, carry handle 253 is on the front sidewall of the nozzle 235. In some embodiments, carry handle 253 is attached to a different portion of the body 201, independent from the nozzle 235. In some embodiments, carry handle 253 is on the left side 101*e* or the right side 101*f* of body 201. Carry handle 253 is independent from handle 109 (FIG. 1). In some embodiments, carry handle 253 is configured to facilitate ease of transport of apparatus 100 while 109 is in a folded position, for example.

At least two wheels 255*a*-255*n* (collectively referred to as "wheel(s) 255") are rotatably coupled with the body 201. Wheels 255 are configured to support at least a portion of the lower side 201*b* of body 201 above a surface in contact with at least one of the at least two wheels 255. Each of the wheels 255*a*-255*n* is independently coupled with body 201 so that each wheel 255 is free to rotate about a corresponding axis of rotation. In some embodiments, at least wheels 255*a* and 255*b* are independently coupled with body 101 by a corresponding axle 257*a*, 257*b* and pin fastener 259*a*, 259*b*. In some embodiments, wheels 255*a* and 255*b* are each attached to a single axle that extends from the first side 201*e* of body 201 to the second side 201*f* of body 201. In some embodiments, if attached to a single axle, each of wheels 255*a* and 255*b* is configured to rotate independently around the single axle. In some embodiments, at least wheels 255*c* and 255*d* are each attached to a single corresponding axle that extends from wheel 255*c* to wheel 255*d*. In some embodiments, if attached to a single axle, each of wheels 255*c* and 255*d* is configured to rotate independently around the single axle.

Wheels 255*a* and 255*b* are larger in diameter than wheels 255*c* and 255*d*. Wheels 255*a* and 255*b* are configured to separate the lower side 201*b* of body 201 away from a surface beneath the body 201 that is in contact with at least one of wheels 255*a* or 255*b* to promote air flow out of at least fourth air passage 247 or cavity air passage 251. In some embodiments, wheels 255*c* and 255*d* have a diameter configured to facilitate contact between the skid portion 237 of nozzle 235 and a surface beneath the body 201. In some embodiments, the one or more axles around which wheels 255*c* and 255*d* are each configured to rotate is coupled with at least one height adjuster 260. Height adjuster 260 is configured to raise or lower wheels 255*c* and 255*d* with respect to the lower side 201*b* of body 201. In some embodiments, the at least one height adjuster 260 is a manual adjustment member configured to be manipulated to move and lock the wheels 255*c* and 255*d* into one of at least two predetermined positions. In some embodiments, the at least one height adjuster 260 is a motor communicatively coupled with controller 211. In some embodiments, controller 211 is configured to cause the at least one height adjuster 260 to move the wheels 255*b* and 255*c* based on a selected one of at least two preset positions with respect to the lower side 201*b* of body 201.

In some embodiments, a surface detection sensor 261 is on the lower side 201*b* of body 201 communicatively coupled with controller 211. The surface detection sensor 261 comprises one or more of a distance sensor configured to detect a distance between the lower side 201*b* of body 201 and a surface beneath the body 201; a location sensor configured to detect a geographic position of the body 201, the controller 211 being configured to determine a type of surface beneath the body 201 based on the detected location of the body 201; a photo-eye; a light sensor; a floor-type detector configured to identify if the surface beneath the body 201 is a hard surface or a carpet, and one or more of a type of hard surface (e.g., hardwood, ceramic, linoleum, laminate flooring, or other suitable material), a pile height of a carpet, or a weave-type of a carpet; or some other suitable type of sensor capable of collecting data based upon which a type of surface beneath the body 201 is capable of being identified. In such an embodiment, the controller 211 is configured to one or more of cause the height adjuster 260 to change the position of wheels 255*c* and 255*d* based on the type of surface determined based on data collected from the surface detection sensor 261, cause an alert to be output indicating the type of surface beneath the body 201, or cause a status of the height of the wheels 255*c* and 255*d* to be output indicating that the height of wheels 255*c* and 255*d* is acceptable for the detected type of surface beneath body 201 or that the height of wheels 255*c* and 255*d* should be adjusted based on the detected type of surface beneath the body 201.

An agitator 263 is on the lower side 201*b* of body 201. Agitator 263 is communicatively coupled with the agitator motor 215. Agitator 263 is a rotary brush. In some embodiments, agitator 263 is a spin-brush, other suitable type brush, or some other suitable structure capable of disturbing, sweeping or agitating a surface beneath the lower side 201*b* of body 201 in contact with agitator 263. In some embodiments, agitator 263 comprises a plurality of bristles, a squeegee, one or more blades, or other suitable topography or material. Agitator motor 215 is configured to cause the agitator 263 to rotate or move, based on one or more of a type of agitator 263, power caused to be supplied to the agitator motor 215 or an instruction output by the controller 211. In some embodiment agitator motor 215 is configured to cause agitator 263 to rotate in a direction toward one or more of third air passage 233, the skid portion 237 of nozzle 235 or the slot 265 defined within the skid portion 237. In some embodiments, agitator motor 215 is configured to cause agitator 263 to rotate in a direction opposite to a direction of movement of body 201.

In some embodiments, the apparatus 100 is configured to improve user operability by facilitating forward and backward cleaning of a surface beneath the apparatus 100. In some embodiments, one or more of controller 211 or agitator motor 215 is configured to cause the agitator 263 to move jn a first direction based on a determination that cleaning fluid is not being expelled from fluid output 241 and in a second direction different from the first direction based on a determination that cleaning fluid is being expelled from fluid output 241, increasing the operability and cleaning performance capabilities of the apparatus 100.

In some embodiments wheels 255*c* and 255*d* are configured to maximize an amount that agitator 263 is in contact with a surface beneath the body 201. In some embodiments, the controller 211 is configured to cause the height of the wheels 255*c* and 255*d* to be adjusted based on the type of surface beneath the body 201. In some embodiments, the controller 211 is configured to determine whether the agitator 263 should penetrate deeply into the surface beneath the body 201, lightly contact the surface beneath the body 201, or be free from contacting the surface beneath the body 201, based on the detected type of surface beneath the body 201.

In some embodiments, the agitator motor 215 is configured to adjust the height of the agitator 263 with respect to the lower side 201*b* of body 201. In some embodiments, the controller 211 is configured to one or more of cause the agitator motor 215 to adjust the height of the agitator 263 with respect to the lower side 201*b* of body 201 or cause the agitator motor 215 to not cause the agitator 263 to rotate based on a detected type of surface beneath the body 201. In some embodiments, the height of agitator 263 with respect to the lower side 201*b* of body 201 is configured to be manually adjusted. In some embodiment, the height of one or more of agitator 263 or wheels 255*c* and 255*d* with respect to the lower side 201*b* of body 201 is fixed.

In some embodiments, a movement sensor 267 is communicatively coupled with controller 211. The movement sensor 267 is configured to detect a direction the body 201 moves. In some embodiments, movement sensor 267 comprises one or more of a rotation sensor configured to detect a rotation direction of at least one of wheels 255, a gps unit, a gyroscope, or other suitable sensor configured to collect data upon which the controller 211 is capable of determining the direction of movement of body 201 based on data received from the movement sensor 267. In some embodiments, controller 211 is configured to cause the agitator motor 215 to cause the agitator 263 to rotate in a direction opposite to the direction of movement of the body 201. In some embodiments, controller 211 is configured to cause based the agitator motor 215 to cause the agitator 263 to rotate in a direction opposite to a rotation direction of wheels 255. In some embodiments, controller 211 is configured to cause based the agitator motor 215 to cause the agitator 263 to rotate in a direction toward the front side 201*c* of body 201 if the body 201 is moving in a forward direction and in a direction toward the rear side 201*d* of body 201 if the body 201 is moving in a backward direction, based on the detected direction of movement of body 201.

The lower side 101*b* of body 201 has an agitator cavity 269 defined by one or more sidewalls of body 201. The agitator cavity 269 is configured to accommodate the agitator 263 such that a first portion of the agitator 263 is within the agitator cavity 269 and a second portion of the agitator 263 is exposed in a direction away from the body 201. In some embodiments, the fluid output 241 is inside the agitator cavity 269. In some embodiments fluid output 241 is positioned inside the agitator cavity 269 such that the agitator 263 is between the fluid output 241 and a surface beneath the body 201. In some embodiments, fluid output 241 is positioned inside the agitator cavity 269 to wet the agitator 263 with cleaning fluid expelled from the fluid output 241. In some embodiments, fluid output 241 is positioned inside the agitator cavity 269 in a location to facilitate direct application of the cleaning fluid expelled from fluid output 241 onto a surface beneath the body 201. In some embodiments, the fluid output 241 is positioned outside the agitator cavity 269 in a location to facilitate direct application of the cleaning fluid expelled from fluid output 241 onto a surface beneath the body 201. In some embodiments, body 201 has more than one fluid output 241 positioned in one or more locations on body 201.

The agitator cavity 269 is free from including the third air passage 233 or an air passage through a sidewall of body 201 defining the agitator cavity 269 in communication with third air passage 233 or nozzle flow path 239.

In some embodiments, if agitator 263 is a rotary brush, agitator 263 is configured to be mounted in agitator cavity 269 by way of at least one brush roll cover 271. Brush roll cover 271 is configured to be removably attached the right side 201*f* of body 201. In some embodiments, brush roll cover 271 is configured to be removably attached to the left side 201*e* of body 201. In some embodiments, body 201 comprises a brush roll cover 271 on each of the left side 201*e* and the right side 201*f* of body 201. Brush roll cover 271 is configured to support the agitator 263 in a manner that allows the agitator 263 to rotate within the agitator cavity 269. In some embodiments, brush roll cover 271 is configured to support the agitator 263 in a manner that allows the agitator 263 to rotate within the agitator cavity 269 such that the agitator 263 is free from having an axle passing through the agitator 263 or around which the agitator 263 is configured to rotate.

Figure 3:
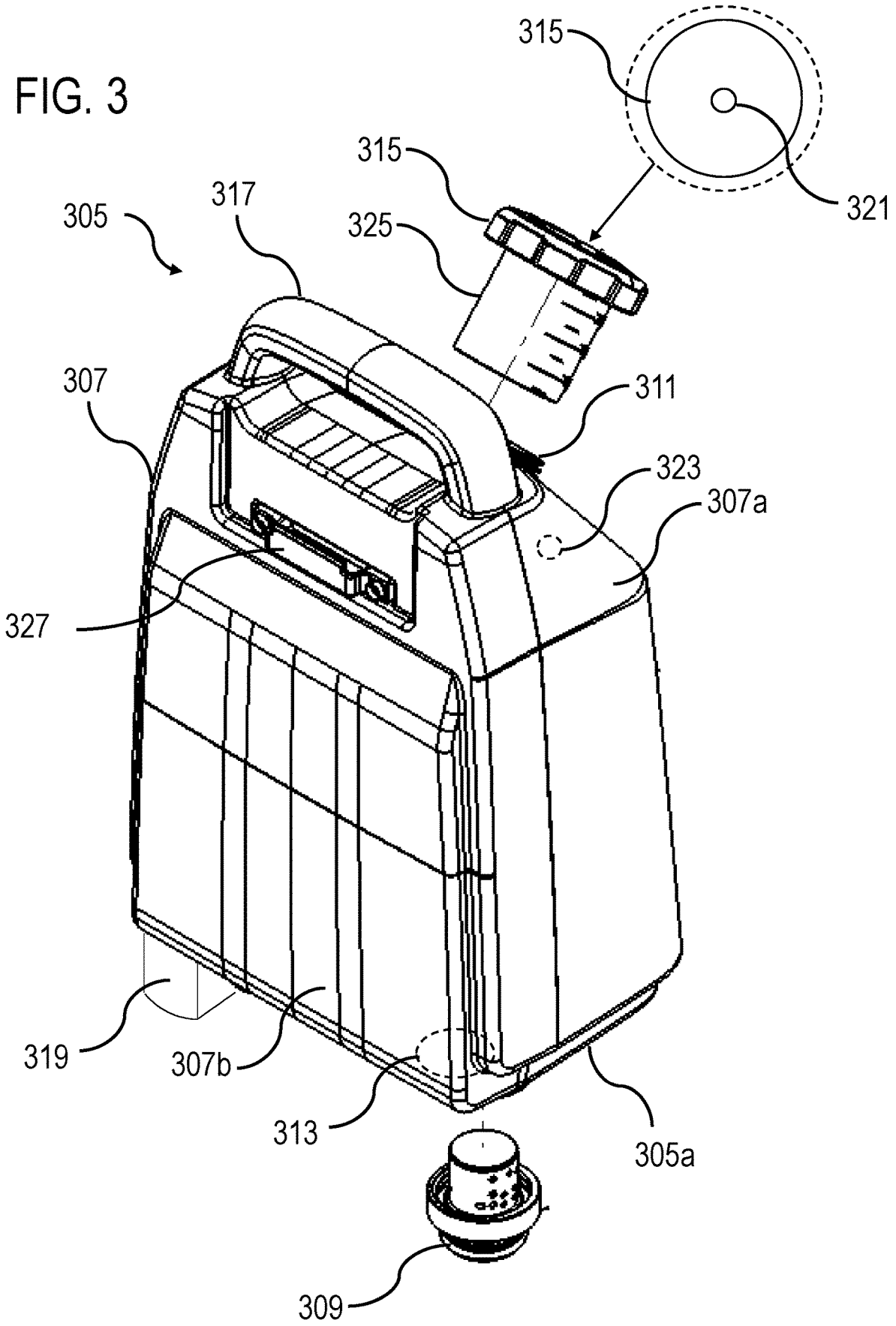
FIG. 3 is an exploded view of a cleaning fluid tank, in accordance with some embodiments.

FIG. 3 is an exploded view of a cleaning fluid tank 305, in accordance with some embodiments. Cleaning fluid tank 305 is usable as cleaning fluid tank 105 (FIG. 1) in apparatus 100 (FIG. 1). Cleaning fluid tank 305 comprises a vessel 307 configured to accommodate cleaning fluid, a body fluid coupling 309, a vessel inlet 311, a vessel outlet 313, a cap 315, a handle 317 and one or more tank alignment supports 319.

Vessel 307 comprises one or more sidewalls defining a cavity therein. Vessel 307 is configured to hold a predetermined volume of cleaning fluid comprising one or more of a liquid, a solid, water, a detergent, a gas, or some combination thereof. The one or more sidewalls of vessel 307 comprise one or more of a polymer, a metal, glass, a composite material, or some other suitable material capable of holding the predetermined volume of cleaning fluid. In some embodiments, at least one sidewall of the one or more sidewalls of vessel 307 comprises a transparent material. In some embodiments, at least one sidewall of the one or more sidewalls of vessel 307 comprises an opaque material. In some embodiments, at least one sidewall of the one or more sidewalls of vessel 307 comprises a translucent material capable of hiding waste material within the vessel 307 from plain view while allowing some light to pass through the vessel 307 such that a volume of cleaning fluid accommodated therein is viewable from outside the vessel 307.

The body fluid coupling 309 is configured to be communicatively coupled with a tank fluid coupling on body 101 (FIG. 1), such as tank fluid coupling 225 (FIG. 2) on body 201 (FIG. 2), or some other suitable connector. The body fluid coupling 309 is configured to mate with the tank fluid coupling on body 101 to facilitate flow of cleaning fluid from the cleaning fluid tank 305 through vessel outlet 313 and into the tank fluid coupling of body 101. In some embodiments, body fluid coupling 309 is configured to be inserted into the tank fluid coupling of body 101. Body fluid coupling 309 is on a lower side 305*a* of cleaning fluid tank 305. In some embodiments, body fluid coupling 309 extends away from the lower side 305*a* of cleaning fluid tank 305. The cleaning fluid tank 305 comprises one or more tank alignment supports 319 on the lower side 305*a* of cleaning tank 305. In some embodiments, the one or more tank alignment supports 319 are configured to extend to a distance away from a reference position within the cleaning fluid tank 305 that is substantially equal to a distance that the body fluid coupling 309 extends in a direction away from the reference position within the cleaning fluid tank 305. In some embodiments, the one or more tank alignment supports 319 are configured to prevent the cleaning fluid tank 305 from tipping over on account of an amount that the body fluid coupling 309 extends away from the lower side 305*a* of the cleaning fluid tank 305. In some embodiments, the one or more tank fluid supports 319 are configured to mate with a cleaning fluid tank alignment guide on body 101 such as cleaning fluid tank alignment guide 243 (FIG. 2) of body 201.

Cap 315 is configured to close the vessel inlet 311. The cap 315 has an air hole 321. In some embodiments, the vessel 307 has the air hole 321 in an upper portion 307*a* of the vessel 307. In some embodiments, the cap 315 has the air hole 321 and the sidewall of the vessel 307 has an additional air hole 323 in the upper portion 307*a* of the vessel 307. In some embodiments, the cleaning fluid tank 305 is free from having a straw or tube extending from a lower portion 307*b* of the vessel 307 to the upper portion 307*a* of the vessel 307.

The body fluid coupling 309 is configured to prevent cleaning fluid from flowing out of the vessel 307 unless the body fluid coupling 309 is coupled with the tank fluid coupling of body 101. For example, if the body fluid coupling 309 is coupled with tank fluid coupling 225 of body 201, the tank electrical contact 221 is inserted into body fluid coupling 309. The body fluid coupling 309 comprises a valve that is configured to open upon insertion of the tank electrical contact 221. In some embodiments, the body fluid coupling 309 comprises a different suitable type of valve or seal that is capable of being opened upon connection with the tank fluid coupling on body 101. In some embodiments, a pin such as that discussed with respect to electrical contact 221 of body 201 is free from having an electrical connection and is solely configured to be a fluid release mechanism on body 101.

In some embodiments, one or more of air hole 321 or optional air hole 323 is pin-sized in diameter. The pin-size diameter is small enough to prevent fluid to flow out of the vessel 307 unless the body fluid coupling 309 is opened.

In some embodiments, cap 315 comprises a measuring cup portion 325 configured to fit within the vessel inlet 311 and inside the vessel 307 if the cap 307 closes the vessel inlet 311. The measuring cup portion 325 is separated from an inner surface of the cap 315 by a gap configured to allow air to flow into or out of the vessel 307, around the measuring cup portion 325, and through air hole 321. The gap between the measuring cup portion 325 and the inner surface of the cap 315 makes it possible for the measuring cup portion 325 to hold a volume of a fluid without the cleaning fluid leaking out through the air hole 321.

In some embodiments, cleaning fluid tank 305 comprises cleaning tank locking member 327 configured to be coupled with a corresponding locking mechanism of tank base 103 such that cleaning fluid tank 305 is removably secured to tank base 103.

Figure 4:
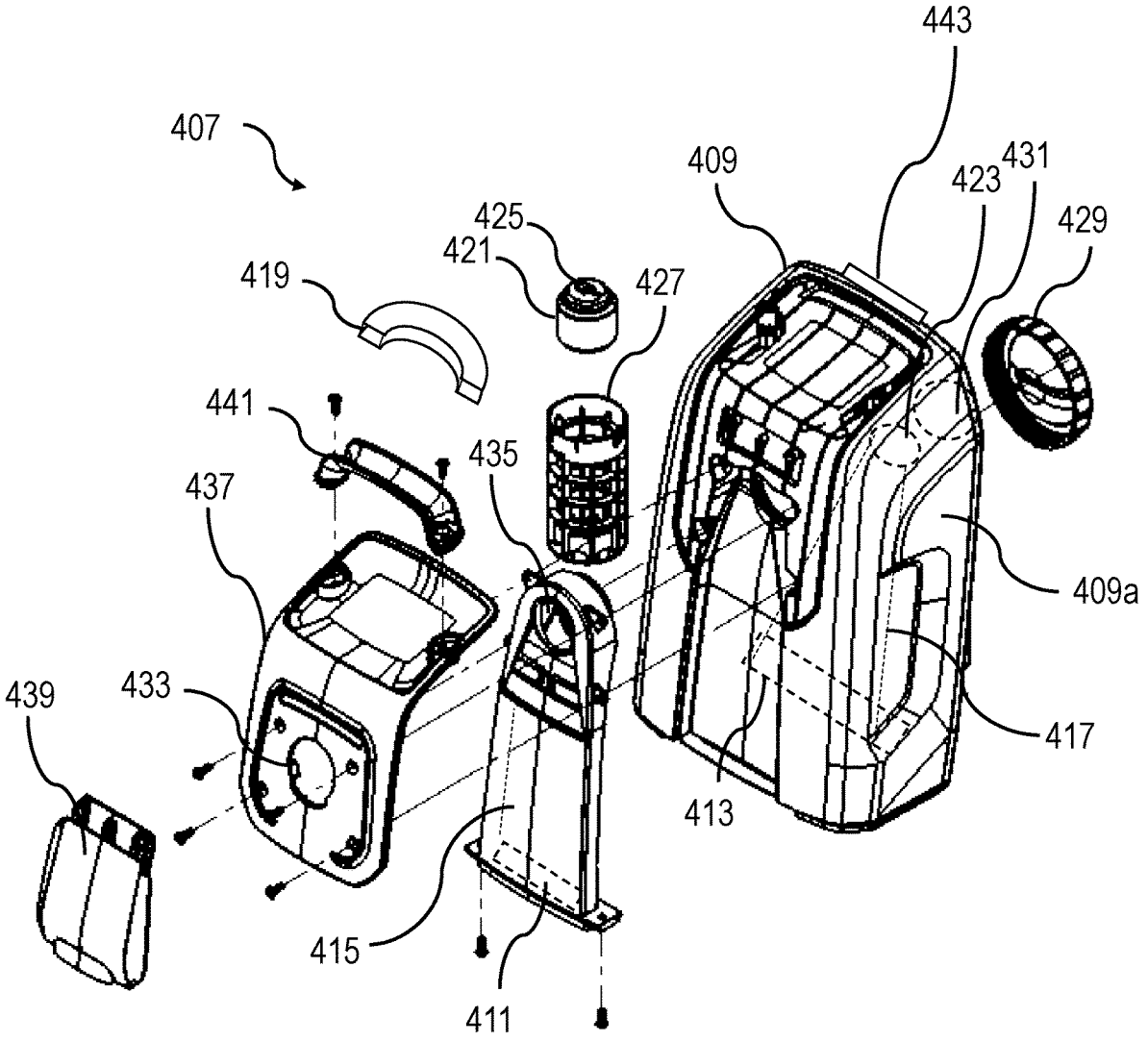
FIG. 4 is an exploded view of a recovery tank, in accordance with some embodiments.

FIG. 4 is an exploded view of a recovery tank 407, in accordance with some embodiments. Recovery tank 407 is usable as recovery tank 107 (FIG. 1) in apparatus 100 (FIG. 1). Recovery tank 407 comprises a recovery tank vessel 409 configured to accommodate a composition comprising one or more of a liquid, a solid, a gas, or a portion of the cleaning fluid output from the cleaning fluid tank 105 (FIG. 1). Recovery tank 407 includes a first recovery tank air passage 411 configured to be communicatively coupled with an air passage on body 101 such as first air passage 229 (FIG. 2) of body 201 (FIG. 2), a second recovery tank air passage 413 configured to be communicatively coupled with another air passage on body 101 such as second air passage 231 of body 201, a first flow path 415 extending from the first recovery tank air passage 411 to an upper half 409*a* of recovery tank vessel 409, a second flow path 417 extending from second recovery tank air passage 413 to the upper half 409*a* of recovery tank vessel 409.

Recovery tank vessel 409 comprises one or more sidewalls defining a cavity therein. Recovery tank vessel 409 is configured to hold a predetermined volume of the composition comprising one or more of the liquid, solid, gas, or portion of the cleaning fluid. The one or more sidewalls of recovery tank vessel 409 comprise one or more of a polymer, a metal, glass, a composite material, or some other suitable material capable of holding the predetermined volume of composition comprising one or more of the liquid, solid, gas, or portion of the cleaning fluid. In some embodiments, at least one sidewall of the one or more sidewalls of recovery tank vessel 409 comprises a transparent material. In some embodiments, at least one sidewall of the one or more sidewalls of recovery tank vessel 409 comprises an opaque material. In some embodiments, at least one sidewall of the one or more sidewalls of recovery tank vessel 409 comprises a translucent material capable of hiding waste material within the recovery tank vessel 409 from plain view while allowing some light to pass through the recovery tank vessel 409 such that a volume of the composition accommodated therein is viewable from outside the recovery tank vessel 409.

First flow path 415 is defined by one or more sidewalls of recovery tank 407 that are external to recovery tank vessel 409. In some embodiments, first flow path 415 is configured to be removably attached to one or more outer sidewalls of recovery tank vessel 409. In some embodiments, first flow path 415 is fixed to one or more outer sidewalls of recovery tank vessel 409. In some embodiments, first flow path 415 is defined by one or more sidewalls of recovery tank 407 that are internal to recovery tank vessel 409. In some embodiments, first flow path 415 is configured to be removably attached to one or more inner sidewalls of recovery tank vessel 409. In some embodiments, first flow path 415 is fixed to one or more inner sidewalls of recovery tank vessel 409.

Second flow path 417 is defined by one or more sidewalls of recovery tank 407 that are internal to recovery tank vessel 409. In some embodiments, second flow path 417 is defined by one or more sidewalls of recovery tank 407 that are external to recovery tank vessel 409. In some embodiments, second flow path 417 is configured to be removably attached to one or more inner sidewalls of recovery tank vessel 409. In some embodiments, second flow path 417 is fixed to one or more inner sidewalls of recovery tank vessel 409.

In some embodiments, a diverter 419 is internal to recovery tank vessel 409. Diverter 419 is configured to change a direction of flow of the liquid, solid, gas or portion of the fluid drawn into the recovery tank vessel 409 by way of the first flow path 415. In some embodiments, diverter 419 is at an outlet of the first flow path 415 through which the liquid, solid, gas or portion of the fluid drawn into the recovery tank vessel 409 flows. In some embodiments, diverter 419 is curved so that the liquid, solid, gas or portion of the fluid drawn into the recovery tank vessel 409 is directed away from a center portion of the interior of recovery tank vessel 409. In some embodiments, diverter 419 is some other suitable shape configured to direct the liquid, solid, gas or portion of the fluid drawn into the recovery tank vessel 409 away from the center portion of the interior of recovery tank vessel 409. In some embodiments, diverter 419 configured to prevent or reduce an amount of foam generated inside the recovery tank vessel 409 as the liquid, solid, gas or portion of the fluid is drawn into the recovery tank vessel 409 by directing the flow away from the center portion of the interior of recovery tank vessel 409. In some embodiments, diverter 419 configured to prevent or reduce an amount of foam generated inside the recovery tank vessel 409 as the liquid, solid, gas or portion of the fluid is drawn into the recovery tank vessel 409 by causing a turbulent flow that breaks-down foam generated inside the recovery tank vessel 409.

Diverter 419 comprises a rigid structure. In some embodiments, diverter 419 is removably attached to an interior of the recovery tank vessel 409. In some embodiments, diverter 419 is removably attached to an interior of the first flow path 415. In some embodiments, diverter 419 is a flexible or movable structure configured to be manipulated into one or more positions to adjust a direction of flow or a degree of turbulence caused. In some embodiments, diverter 419 is fixed to an interior of the recovery tank vessel 409. In some embodiments, diverter 419 is fixed to an interior of the first flow path 415.

In some embodiments, recovery tank 407 includes a stopper 421 inside the recovery tank vessel 409. The stopper 421 is configured to at least substantially seal the second flow path 417 based, at least in part, on a volume of the liquid, solid, gas or portion of the fluid composition accommodated by the recovery tank vessel 409. In some embodiments, the stopper 421 comprises a flotation device that is configured to rise toward an opening 423 of the second flow path 417 through which air flows between top half 409*a* of the recovery tank vessel 409 and the second flow path 417. In some embodiments, stopper 421 is spherical and is configured to substantially seal the opening 423 based on one or more of a depth of the composition accommodated by recovery tank vessel 409 or a suction of air from second flow path 417 by a vacuum motor of body 101, such as vacuum motor 213 (FIG. 2) of body 201.

In some embodiments, stopper 421 comprises at least one plug configured to substantially seal the opening 423 based on one or more of a depth of the composition accommodated by recovery tank vessel 409 or a suction of air from second flow path 417 by the vacuum motor of body 101. In some embodiments, the at least one plug is configured to one or more of cover the opening 423 or fit inside the second flow path 417 by way of opening 423. In some embodiments, stopper 421 comprises a depth indicator 425 detectable by a controller of body 101, such as controller 211 (FIG. 2). Depth indicator 425 comprises one or more of a sensor, an electrical contact, or other suitable device configured to be communicatively coupled with the controller of the body 101 to sense whether the stopper 421 is in position to substantially seal the second flow path 417, or a predetermined distance away from a bottom of recovery tank vessel 409, indicative of a depth of the composition accommodated within recovery tank vessel 409.

In some embodiments, the controller of the body 101 is configured to determine the recovery tank is full based on a determination that the stopper 421 is in position to substantially seal the second flow path 417 or if the stopper 421 is a predetermined distance away from the bottom of the recovery tank vessel 409. In some embodiments, the controller of body 101 is configured to cause the vacuum motor of body 101 to turn off or an alert to be output indicating that the recovery tank 407 is full.

In some embodiments, recovery tank 407 comprises a cage 427 configured to allow the stopper 421 to move freely between an inside of the cage 427 and opening 423 of the second flow path 417. In some embodiments, cage 427 is configured to be removably attached to an interior of recovery tank vessel 409 and accommodated within recovery tank vessel 409. In some embodiments cage 427 is fixed to the interior of recovery tank vessel 409. In some embodiments, cage 427 is configured to be removably attached to an interior of second flow path 417 and configured to be accommodated within recovery tank vessel 409. In some embodiments, cage 427 is fixed to an interior of second flow path 417 and accommodated within recovery tank vessel 409.

In some embodiments, recovery tank 407 comprises a recovery tank cap 429 configured to close a drain opening 431 defined by one or more sidewalls of recovery tank 407. In some embodiments, cage 427 is configured to be removably attached to the recovery tank cap 429 and configured to be accommodated within recovery tank vessel 409 when the recovery tank cap 429 is attached to close the drain opening 431. In some embodiments, cage 427 is fixed to the recovery tank cap 429 and accommodated within recovery tank vessel 409 when the recovery tank cap 429 is attached to close the drain opening 431.

In some embodiments, recovery tank 407 comprises hose air passage 433 configured to receive a vacuum hose and a third flow path 435 extending from the hose air passage 433 to the upper half 409*a* of recovery tank vessel 409. In some embodiments, third flow path 435 intersects first flow path 415. In some embodiments, third flow path 435 is configured to access the upper half 409*a* of recovery tank vessel 409 independent from first flow path 415. In some embodiments, if third flow path 435 intersects first flow path 415, the one or more sidewalls of recovery tank 407 that define the first flow path 415 and/or the second flow path 435 are configured to accommodate a hose received by way of the hose air passage 433 such that the upper half 409*a* of recovery tank vessel 409 is communicatively coupled with the vacuum hose and the first flow path 415 is at least substantially closed off from the upper half 409*a* of recovery tank vessel 409 by a portion of the vacuum hose inserted into hose air passage 433 extends into the recovery tank vessel 409.

In some embodiments, the hose air passage 433 is defined by one or more sidewalls of the recovery tank vessel 409. In some embodiments, the hose air passage 433 is defined by one or more sidewalls external to the recovery tank vessel 409. In some embodiments, hose air passage 433 is defined by one or more sidewalls of a structure external to the recovery tank vessel 409 that comprises the first flow path 415. In some embodiments, hose air passage 433 is defined by one or more sidewalls of a cover 437 removably attached to one or more sidewalls of the recovery tank vessel 409 or a structure external to the recovery tank vessel 409 that comprises the first flow path 415. In some embodiments, hose air passage 433 is defined by one or more sidewalls of a cover 437 that is fixed to one or more sidewalls of the recovery tank vessel 409 or a structure external to the recovery tank vessel 409 that comprises the first flow path 415.

In some embodiments, recovery tank 407 comprises a closure 439 configured to seal the hose air passage 433. In some embodiments, closure 439 is a cap, a flap, a slideable seal, a rotatable seal, or some other suitable structure configured to at least substantially seal, cover or close the hose air passage 433. In some embodiments, closure 439 is removably attached to an area of recovery tank 407 around or near the hose air passage 433. In some embodiments, closure 439 is removably attached to the one or more sidewalls of the corresponding structure of recovery tank 407 defining the hose air passage 433. In some embodiments, closure 439 is removably attached to the cover 437. In some embodiments, closure 439 is configured to be inserted into hose air passage 433 and removably attached to one or more sidewalls that define the third flow path 435.

In some embodiments, recovery tank 407 comprises a handle 441. Handle 441 is attached to cover 437. In some embodiments, handle 441 is integrally formed with cover 437. In some embodiments, handle 441 is integrally formed with recovery tank vessel 409. In some embodiments, handle 441 is integrally formed with recovery tank vessel 409. In some embodiments, handle 441 is attached to recovery tank vessel 409.

In some embodiments, recovery tank 407 comprises recovery tank locking member 443 configured to be coupled with a corresponding locking mechanism of tank base 103 such that recovery tank 407 is removably secured to tank base 103.

Figure 5:
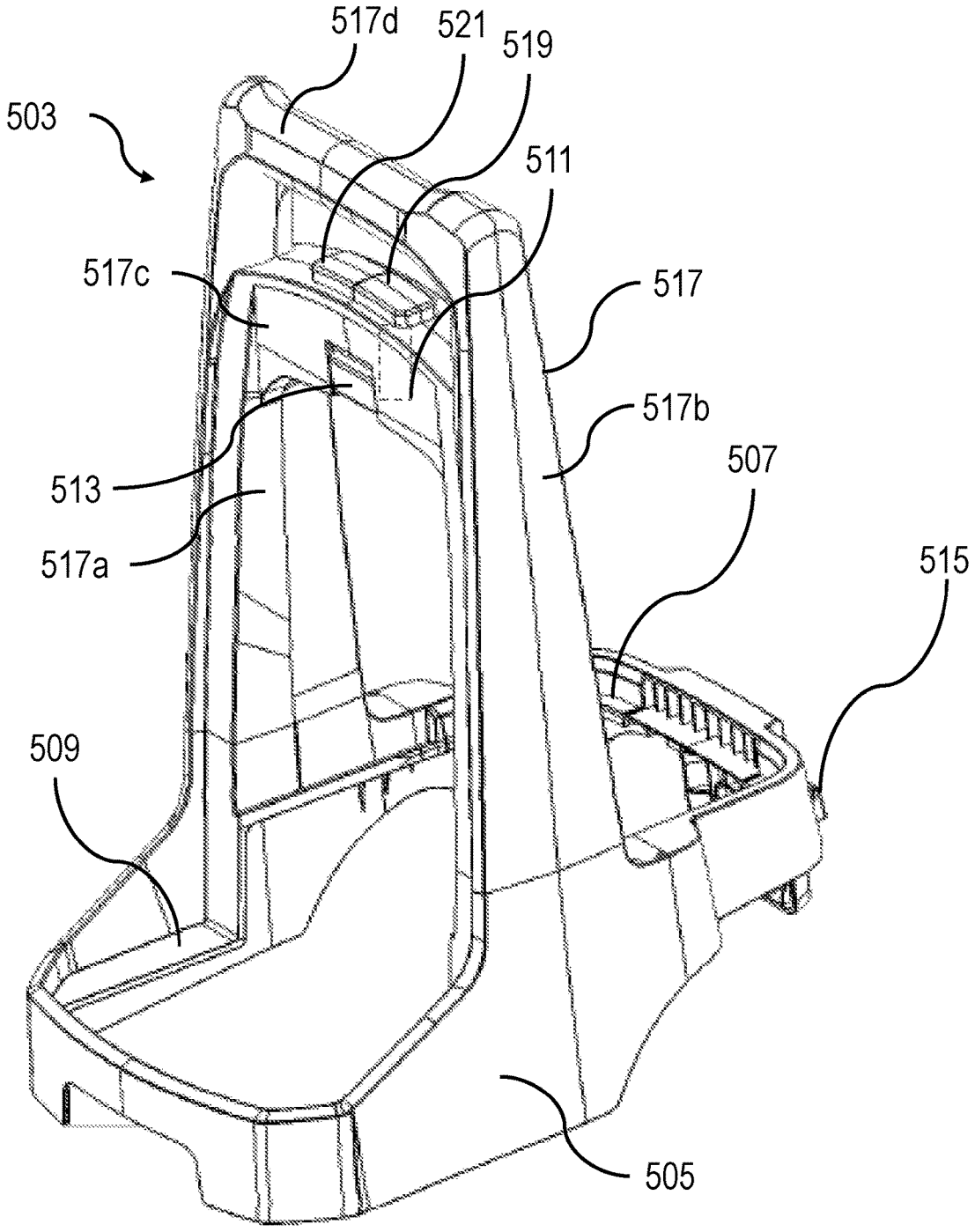
FIG. 5 is a perspective view of a tank base, in accordance with some embodiments.

FIG. 5 is a perspective view of a tank base 503, in accordance with some embodiments. Tank base 503 is usable as tank base 103 (FIG. 1) in apparatus 100 (FIG. 1). Tank base 503 is configured to be positioned over an upper side of body 101 (FIG. 1). Tank base 503 comprises a first support member 505 having a first tank seat 507 configured to accommodate the cleaning fluid tank 105 (FIG. 1) and a second tank seat 509 configured to accommodate the recovery tank 107 (FIG. 1).

In some embodiments, tank base 503 has one or more of a first locking mechanism 511 configured to secure the cleaning fluid tank 105 in the first tank seat 507 or a second locking mechanism 513 configured to secure the recovery tank 107 in the second tank seat 509. In some embodiments, the first locking mechanism 511 is configured to cooperate with a portion of cleaning fluid tank 105 such as cleaning tank locking member 327 (FIG. 3) of cleaning fluid tank 305 (FIG. 3) to removably secure the cleaning fluid tank 105 in the first tank seat 507. In some embodiments, the second locking mechanism 513 is configured to cooperate with a portion of recovery tank 107 such as recovery tank locking member 443 (FIG. 4) of recovery tank 407 (FIG. 4) to removably secure the cleaning fluid tank 105 in the first tank seat 507. In some embodiments, tank base 503 has a third locking mechanism 515 configured to secure the first support member 505 to body 101. For example, third locking mechanism 515 is configured to cooperate with a locking mechanism on body 101 such as locking mechanism 246 (FIG. 2) of body 201 (FIG. 2).

In some embodiments, tank base 503 includes a second support member 517 over the first support member 505. The second support member 517 comprises at least two columns 517*a* and 517*b* that extend away from the first support member and a bridge portion 517*c* connecting the at least two columns 517*a* and 517*b*. In some embodiments, the second support member 517 has an extension portion 517*d* that is at least partially separated from bridge portion 517*c* and configured to be a handle usable to carry the tank base 503. In some embodiments, the at least two columns 517*a* and 517*b*, the bridge portion 517*c* and the extension portion 517*d* are integrally formed as a single structure. In some embodiments, one or more of the at least two columns 517*a* and 517*b*, the bridge portion 517*c*, or the extension portion 517*d* is a separate structure configured to be attached to one or more of the at least two columns 517*a* and 517*b*, the bridge portion 517*c*, or the extension portion 517*d*.

The second support member 517 comprises a first tank release 519 configured to unlock the first locking mechanism 511 and a second tank release 521 configured to unlock the second locking mechanism 513. In some embodiments, one or more of cleaning fluid tank 105 or recovery tank 107 comprises a corresponding handle that, if secured to the tank base 503, makes it possible to carry the tank base 503 with or without extension portion 517*d*. The first locking mechanism 511 and the second locking mechanism 513 is included in the second support member 517. In some embodiments, one or more of the first locking mechanism 511 or the second locking mechanism 513 is included in the first support member 505, and a corresponding tank release is included in the first support member 505.

Tank base 503 is configured to be removably attached to the body 101 with the cleaning fluid tank 105 in the first tank seat 507, the recovery tank 107 in the second tank seat 509, the cleaning fluid tank 105 in the first tank seat 507 and the recovery tank 107 in the second tank seat 509, or free from having either of the cleaning fluid tank 105 in the first tank seat 507 or the recovery tank 107 in the second tank seat 509.

If tank base 503 is separated from body 101, tank base 503 is configured to hold or secure one or more of cleaning fluid tank 105 or recovery tank 107 in the first tank seat 507 or the second tank seat 509 remote from the body 101.

The first support member 505 is configured to facilitate communicative coupling between the cleaning fluid tank 105 and the recovery tank 107 with corresponding air passages, electrical couplings and/or fluidic couplings upon placement of the tank base 503, having the cleaning fluid tank 105 and the recovery tank 107 secured thereto, over the body 101. In some embodiments, the first support member 505 is configured to facilitate communicative coupling between the cleaning fluid tank 105 and the recovery tank 107 with corresponding air passages, electrical couplings and/or fluidic couplings of body 101 upon placing the tank base 503, having the cleaning fluid tank 105 and the recovery tank 107 secured thereto, over the body 101 and securing the tank base 503 to body 101 using third locking mechanism 515. In some embodiments, tank base 503 is configured to one or more of cause the body fluid coupling of cleaning fluid tank 105 to be substantially aligned with the tank fluid coupling of body 101 or cause an air intake passage of recovery tank 107 to be substantially aligned with the first air passage of body 101 if the cleaning fluid tank 105 is in the first tank seat 507 or the recovery tank 107 is in the second tank seat 509, and the tank base 503 is over body 101.

In some embodiments, first support member 505 is configured to be one or more of over or secured to the body 101, absent from having at least one of the cleaning fluid tank 105 or the recovery tank 107 in the first tank seat 507 or the second tank seat 509. The first support member 505 is configured to facilitate communicative coupling between the cleaning fluid tank 105 or the recovery tank 107 with corresponding air passages, electrical couplings and/or fluidic couplings of body 101 upon placement of the cleaning fluid tank 105 or the recovery tank 107 into tank seat 507 or 509, after the tank base 503 was previously located over and/or secured to body 101.

Figure 6A:
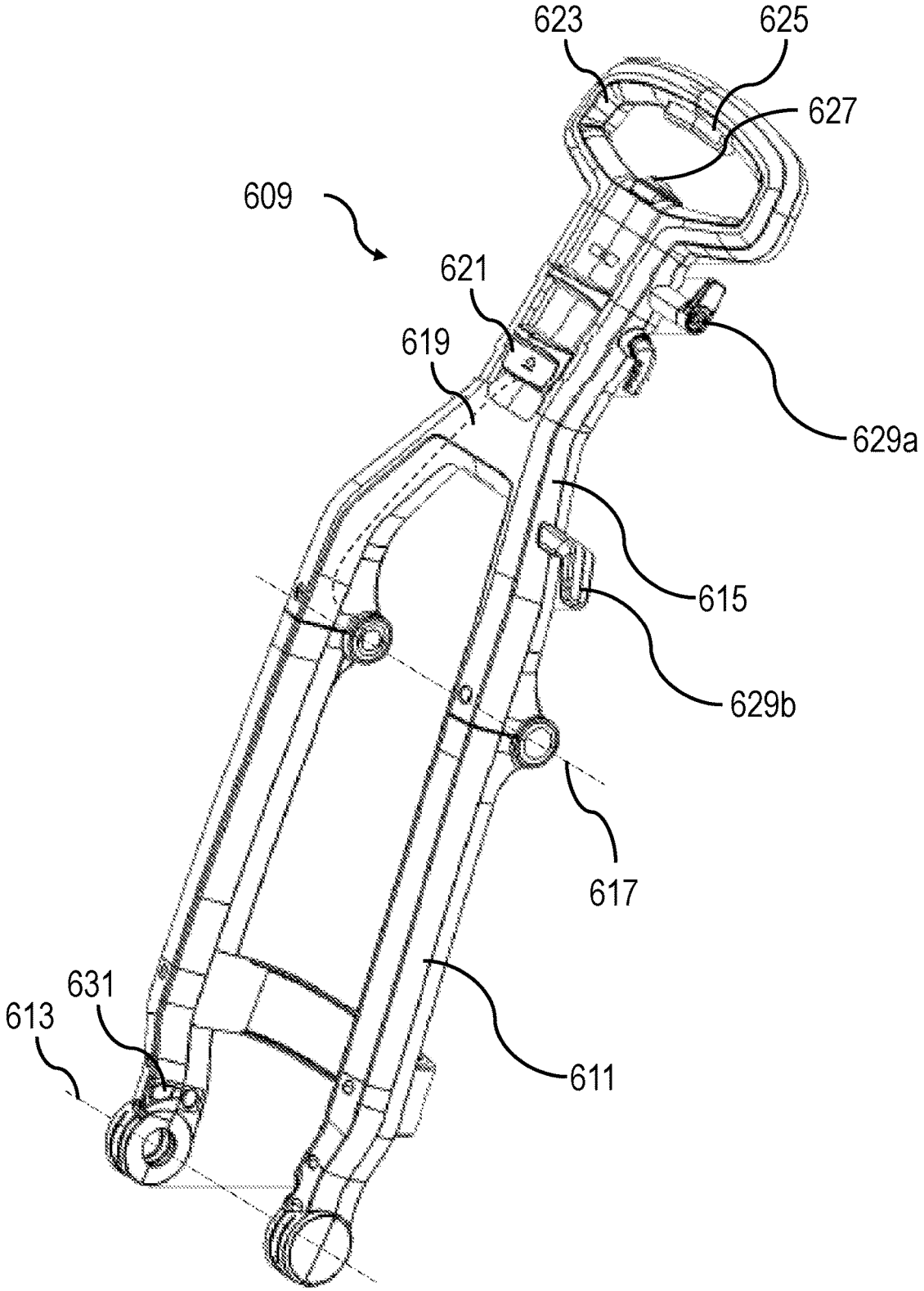
FIG. 6A is a perspective view of a handle, in accordance with some embodiments.

FIG. 6A is a perspective view of a handle 609, in accordance with some embodiments. Handle 609 is usable as handle 109 (FIG. 1) in apparatus 100 (FIG. 1). The handle 609 is configured to be coupled with the body 101 (FIG. 1). Handle 609 includes a first portion 611 configured to be rotatably coupled with the body 101 and configured to rotate about a first axis 613 with respect to the body 101. Handle 609 has a second portion 615 rotatably coupled with the first portion 611 and configured to rotate about a second axis 617 with respect to the first portion 611.

Handle 609 includes a rotation locking mechanism 619 configured to secure the second portion 615 of the handle 609 in a locked position with respect to the first portion 611. Handle 609 has an unlocking mechanism 621 configured to release the rotation locking mechanism 619 to facilitate rotation of the second portion 615 about the second axis 617. Handle 609 includes a grip portion 623. In some embodiments, grip portion 623 is substantially ring-shaped to facilitate ambidextrous operation of the apparatus 100. Grip portion 623 is substantially centered with respect to the second portion 615 of the handle 609. In some embodiments, grip portion 623 is elliptical, circular, square, rectangular, pentagonal, hexagonal, octagonal, or some other suitable shape.

A fluid release button 625 is on an inner side of the grip portion 623. Fluid release button 625 is positioned to facilitate actuation by an operator's fingers when the grip portion 623 is grasped by one or two hands. In some embodiments, a length of the fluid release button 625 is at least ¼ an interior length of the grip portion 623. The fluid release button 625 is configured to be communicatively coupled with a controller of body 101, such as controller 211 (FIG. 2), of body 201 (FIG. 2). The controller is configured to cause fluid to flow from the cleaning fluid tank 105 (FIG. 1) to the fluid output of the body 101 by way of the tank fluid coupling of body 101.

In some embodiments, the apparatus 100 is configured to extract fluid from a surface beneath the body 101 during a pulling operation of the apparatus by way of handle 609. The position of fluid release button 625 improves operability of the apparatus by making the fluid release button 625 easier to operate during the pulling operation. In some embodiments, the controller of body 101 is further configured to cause an agitator of body 101 such as agitator 263 (FIG. 2) of body 201 to move such that the apparatus simultaneously applies cleaning fluid onto a surface and scrubs the surface.

A power button 627 is communicatively coupled with the controller of body 101. Power button 627 is on the handle 609. In some embodiments, the power button 627 is on the second portion 615 of the handle 609. In some embodiments, the power button is within the ring-shape of the grip portion 623 opposite to the fluid release button 625. In some embodiments, power button 627 configured to be movable to one of a first position or a second position. In some embodiments, power button 627 is configured to be movable to one of at least three positions. In some embodiments, power button 627 is on a different portion of the handle 609 or the body 101.

In some embodiments, handle 609 includes hooks 629*a* and 629*b* positioned on the second portion 615 of handle 609 around which an optional power cord is capable of being wrapped. At least one of the hooks 629*a* or 629*b* is rotatably attached to the second portion 615 of handle 609 to cause a cord wrapped around the hooks 629*a* and 629*b* to fall toward the ground based on a position of the hook 629*a* or 629*b*.

Handle 609 comprises a handle locking mechanism 631 configured to secure the lower portion 611 of the handle 609 in a fixed position with respect to the body 101. In some embodiments, the handle locking mechanism 631 comprises a slot configured to cooperate with a detent lock, pin, ring or other suitable structure on body 101 configured to at least temporarily restrict the rotation of the lower portion 611 of handle 609 about first axis 613 with respect to body 101. In some embodiments, the handle locking mechanism 631 comprises a detent lock, pin, ring or other suitable structure configured to cooperate with a slot or other suitable locking member on the body 101 to at least temporarily restrict the rotation of the lower portion 611 of handle 609 about first axis 613 with respect to body 101.

Figure 6B:
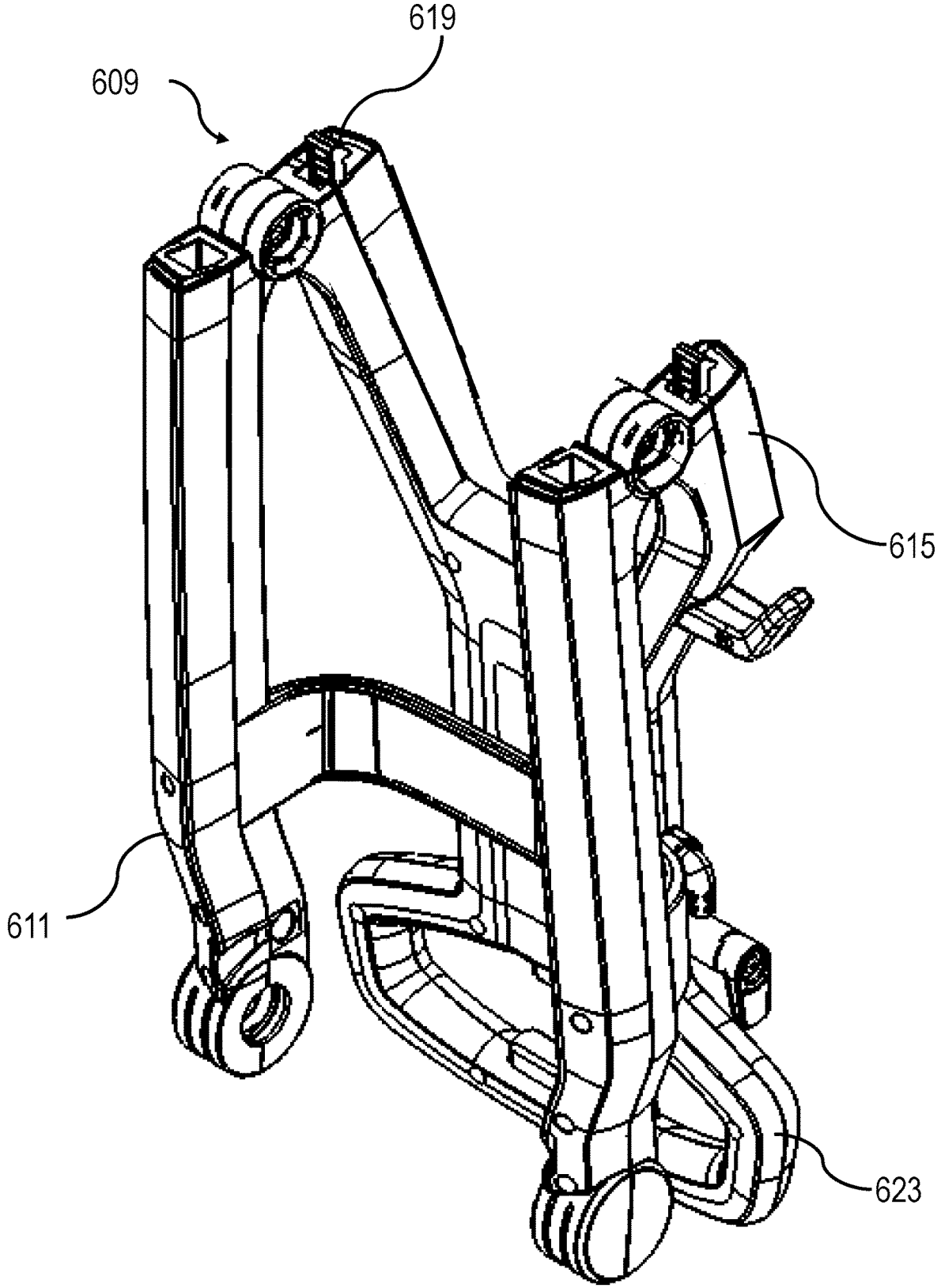
FIG. 6B is a perspective view of handle in a collapsed position, in accordance with some embodiments.

FIG. 6B is a perspective view of handle 609 in a collapsed position, in accordance with some embodiments. In the collapsed position, the second portion 615 of handle 609 is rotated with respect to the first portion 611 of handle 609 such that the grip portion 623 is next to the lower end of first portion 611 configured to be attached to the body 101 of apparatus 100.

Figure 7:
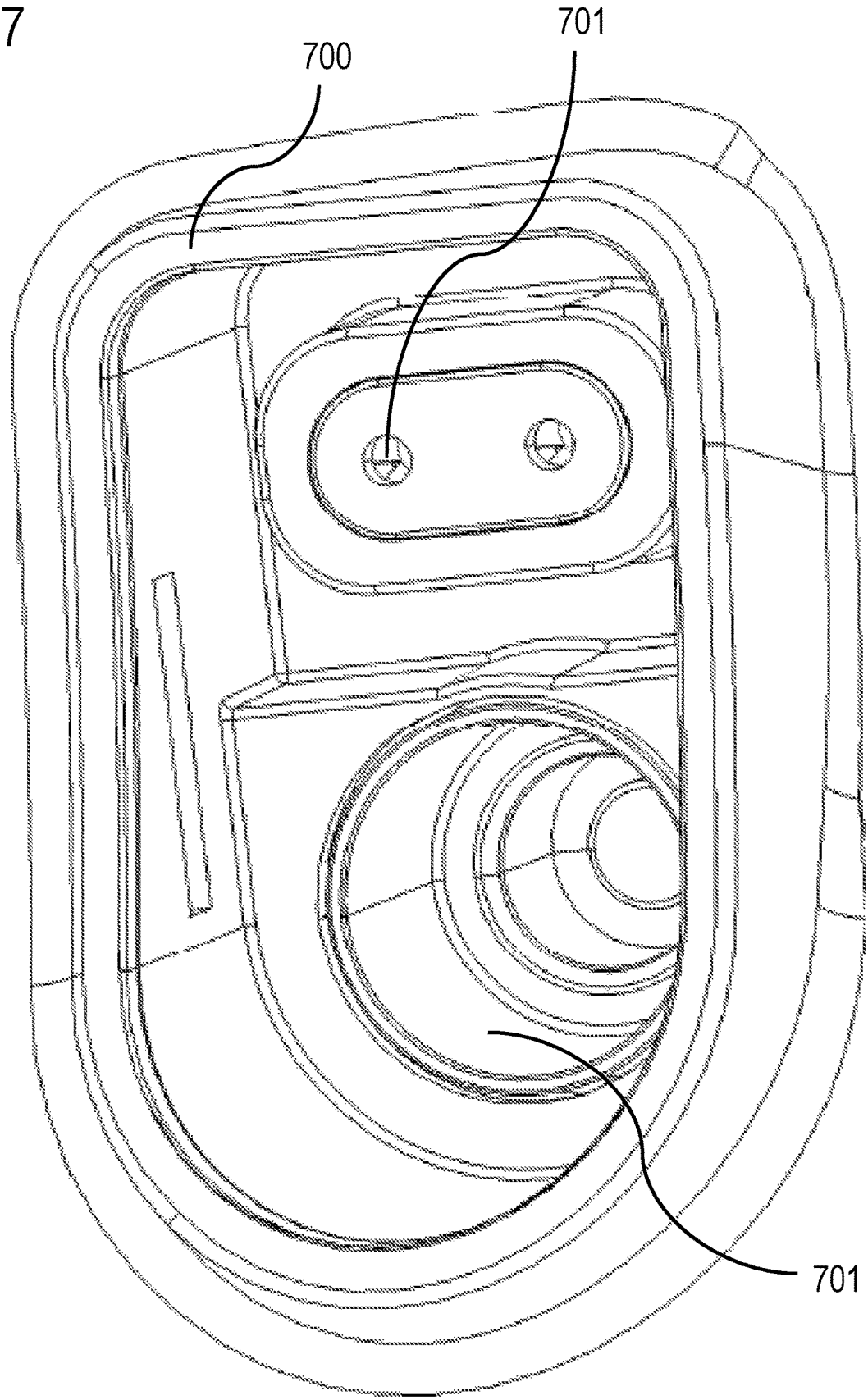
FIG. 7 is a perspective view of an accessory receptacle, in accordance with some embodiments.

FIG. 7 is a perspective view of an accessory receptacle 700, in accordance with some embodiments. Accessory receptacle 700 comprises an accessory electrical contact 701 and an accessory fluid coupling 703. Accessory electrical contact 701 and accessory fluid coupling 703 are usable as accessory electrical contact 223 (FIG. 2) and accessory fluid coupling 227 (FIG. 2) included in body 201 (FIG. 2). In some embodiments, body 101 (FIG. 1) includes accessory receptacle 700, accessory electrical contact 701 and accessory fluid coupling 703 to facilitate the provision of one or more of power or cleaning fluid to an accessory attachment.

In some embodiments, accessory receptacle 700 is configured to receive a plug having a structure configured to fit within the accessory receptacle 700, having a corresponding electrical contact for making an electrical connection between the accessory and the accessory electrical contact 701, and a corresponding fluid coupling configured to engage the accessary fluid coupling 703 to facilitate fluid flow from the accessory fluid coupling 701 to the attached accessory.

Figure 8:
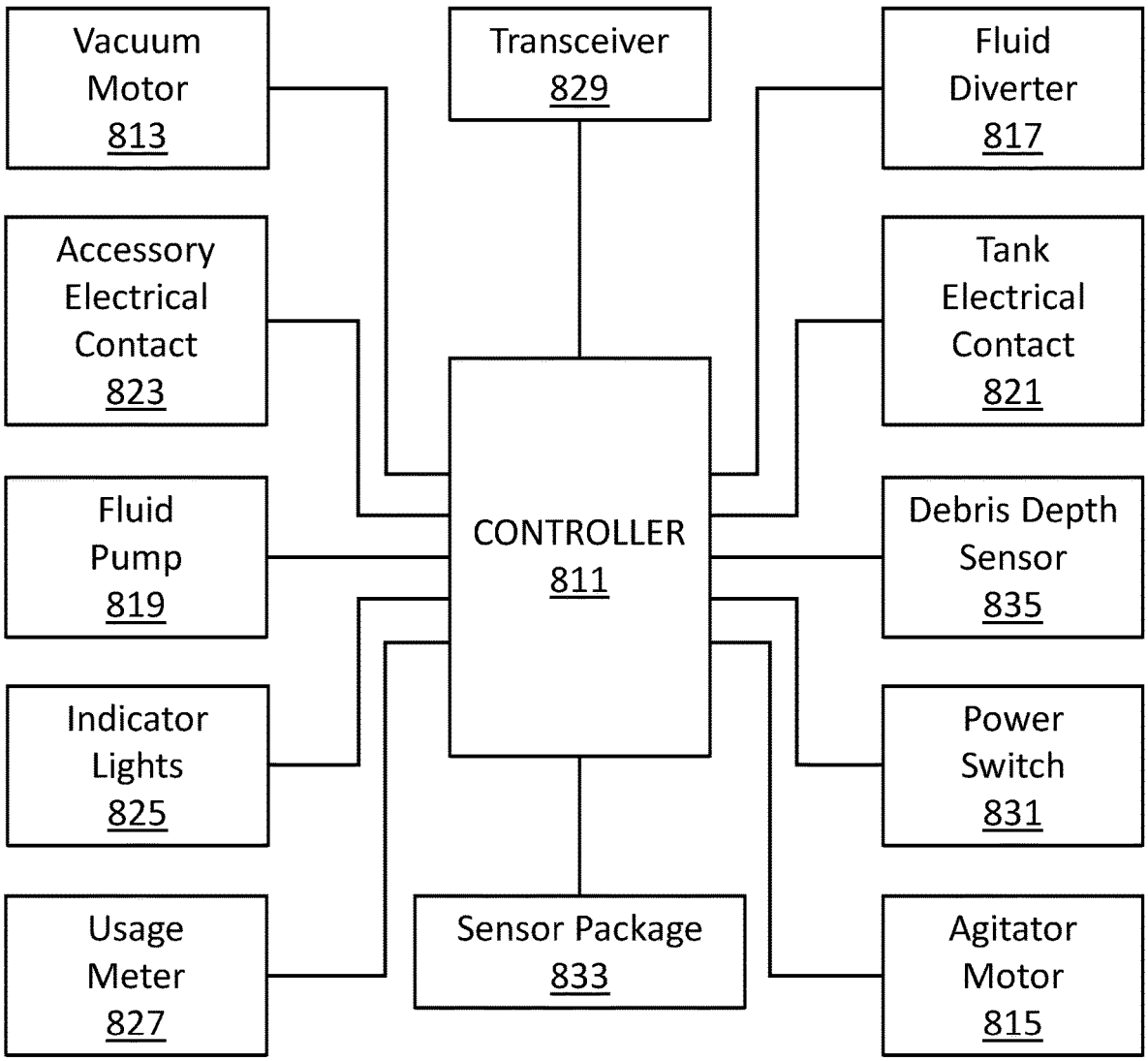
FIG. 8 is a schematic diagram of a control system, in accordance with some embodiments.

FIG. 8 is a schematic diagram of a control system 800, in accordance with some embodiments. One or more components of control system 800 is configured to be incorporated into an extractor system such as apparatus 100 (FIG. 1) or body 201 (FIG. 2), for example. Control system 800 comprises a controller 811 communicatively coupled with a vacuum motor 813, an agitator motor 815, a fluid diverter 817, a fluid pump 819, a tank electrical contact 821, an accessory electrical contact 823, one or more indicator lights 825, usage meter 827, a transceiver 829, a power switch 831, a sensor package 833, and a debris depth sensor 835.

Controller 811 is configured to turn the vacuum motor 813 on or off based on a position of power switch 831. Power switch 831 is similar to power button 627 (FIG. 6), wherein the power switch 831 is configured to be in one of at least two positions. Controller 811 is configured to one or more of cause power to be supplied to the agitator motor 815 or output an instruction to the agitator motor 815 based on the position of the power switch 831 or a position of a fluid release/agitator control switch of apparatus 100 such as fluid release button 625 (FIG. 6). In some embodiments, the controller 811 is configured to cause power to be supplied to the accessory electrical contact 823 based on the position of the power switch 831.

In some embodiments, power switch 831 is configured to be in one of three positions. In a first position, an apparatus such as apparatus 100 which includes control system 800 is off. In a second position, the vacuum motor 813 is turned on and the agitator motor 815 is capable of being turned on, while no power is supplied to the accessory electrical contact 823. In a third position, the vacuum motor 813 is turned on, the brush motor 815 is turned off, and power is supplied to the accessory electrical contact 821 to supply power to an accessory that is communicatively coupled with the apparatus 100. In some embodiments, control 811 is configured to cause fluid to flow from cleaning fluid tank 105 to an accessory attached to the apparatus 100 based on a communication received by way of accessory electrical coupling 823.

In some embodiments, controller 811 is configured to cause fluid to flow from the cleaning fluid tank 105 (FIG. 1) to the fluid output of the body 101 by way of the tank fluid coupling of body 101 based on a position of the power switch 831 and an actuation of the fluid flow switch included in handle 109 such as fluid flow button 625. Based on a detected position of the fluid flow switch, controller 811 is configured to cause fluid pump 819 to draw cleaning fluid from cleaning fluid tank 105. Controller 811 is communicatively coupled with the fluid diverter 817 to cause the fluid diverter 817 to be in position to open a fluid flow path between the tank fluid coupling of body 101 and the fluid output of body 101 and close a fluid flow path between the tank fluid coupling of body 101 and the accessory fluid coupling of body 101.

In some embodiments, indicator lights 825 comprise an agitator status indicator communicatively coupled with the controller 811. The agitator motor 815 comprises an agitator movement sensor communicatively coupled with the controller 811. Controller 811 is configured to determine whether the agitator is moving based on data received from the agitator movement sensor. In some embodiments, the controller 811 is configured to one or more of cause power to stop being supplied to the agitator motor 815, cause the agitator status indicator to be activated based on a determination the agitator is not moving, or cause power to stop being supplied to the vacuum motor 813.

In some embodiments, indicator lights 825 comprise a cleaning fluid tank status indicator communicatively coupled with the controller 811. Controller 811 is configured to determine a volume of cleaning fluid in the cleaning fluid tank 105 based on a conduction of electricity through the cleaning fluid in the cleaning fluid tank 105 by way of the tank electrical contact 821. Controller 811 is configured to cause the tank status indicator to be activated based on the volume of cleaning fluid included in the cleaning fluid tank 105. In some embodiments, if the volume of cleaning fluid in cleaning fluid tank 105 is less than a predetermined threshold, the controller 811 is configured to cause the tank status indicator light to turn on. In some embodiments, if the volume of cleaning fluid in cleaning fluid tank 105 is less than a predetermined threshold, the controller 811 is configured to cause the tank status indicator light to turn off.

Indicator lights 825 are positioned on apparatus 100 such that a user operating the apparatus 100 is able to quickly and easily identify a problem or operating status of the apparatus 100, increasing a user's confidence in the user's ability to operate the apparatus 100, and increasing a user's confidence in identifying whether the apparatus 100 should be filled with cleaning fluid, emptied, serviced, or some other suitable operation capable of being instigated by way of an indicator light.

Usage meter 827 is communicatively coupled with controller 811. In some embodiments, usage meter 827 is configured to indicate an amount of time the apparatus has been in active operation. In some embodiments, usage meter 827 is configured to indicate a cumulative amount of time that the apparatus has been actively operated. In some embodiments, usage meter 827 is configured to indicate an amount of time the apparatus has been in use within a particular period of time. In some embodiments, usage meter 827 is configured to identify a start time and an end time within which the usage meter 827 tracked an amount of time the apparatus has been used between the start time and the end time. In some embodiments, the usage meter 827 is configured to selectively display a cumulative active operation time, an amount of active operation time within a defined time period, or a period of time the apparatus has been away from a particular location. In some embodiments, controller 811 is configured to determine the amount of active operation time based on one or more of the controller 811, the vacuum motor 813 or the actuator motor 815 being activated.

Sensor package 833 comprises one or more of a position sensor, a gps, a gyroscope, or other sensor suitable for collecting data indicative of a location or a direction of movement of the apparatus to be processed by controller 811.

Transceiver 829 is communicatively coupled with controller 811. Transceiver 829 is configured to transmit and receive signals indicative of the amount of time the apparatus 100 has been in active operation, an operating health of the apparatus 100, a usage status of the apparatus 100 or a location of the apparatus 100, a pick-up instruction or a drop-off instruction.

Debris depth sensor 835 comprises one or more of a sensor, an electrical contact, or other suitable device such as debris depth indicator 425 (FIG. 4) configured to be communicatively coupled with the controller 811 to sense whether the stopper included in recovery tank 107 is a predetermined distance away from a bottom of recovery tank 107. In some embodiments, controller 811 is configured to cause the vacuum motor 813 to turn off or an alert to be output indicating that the recovery tank 107 is full.

Figure 9:
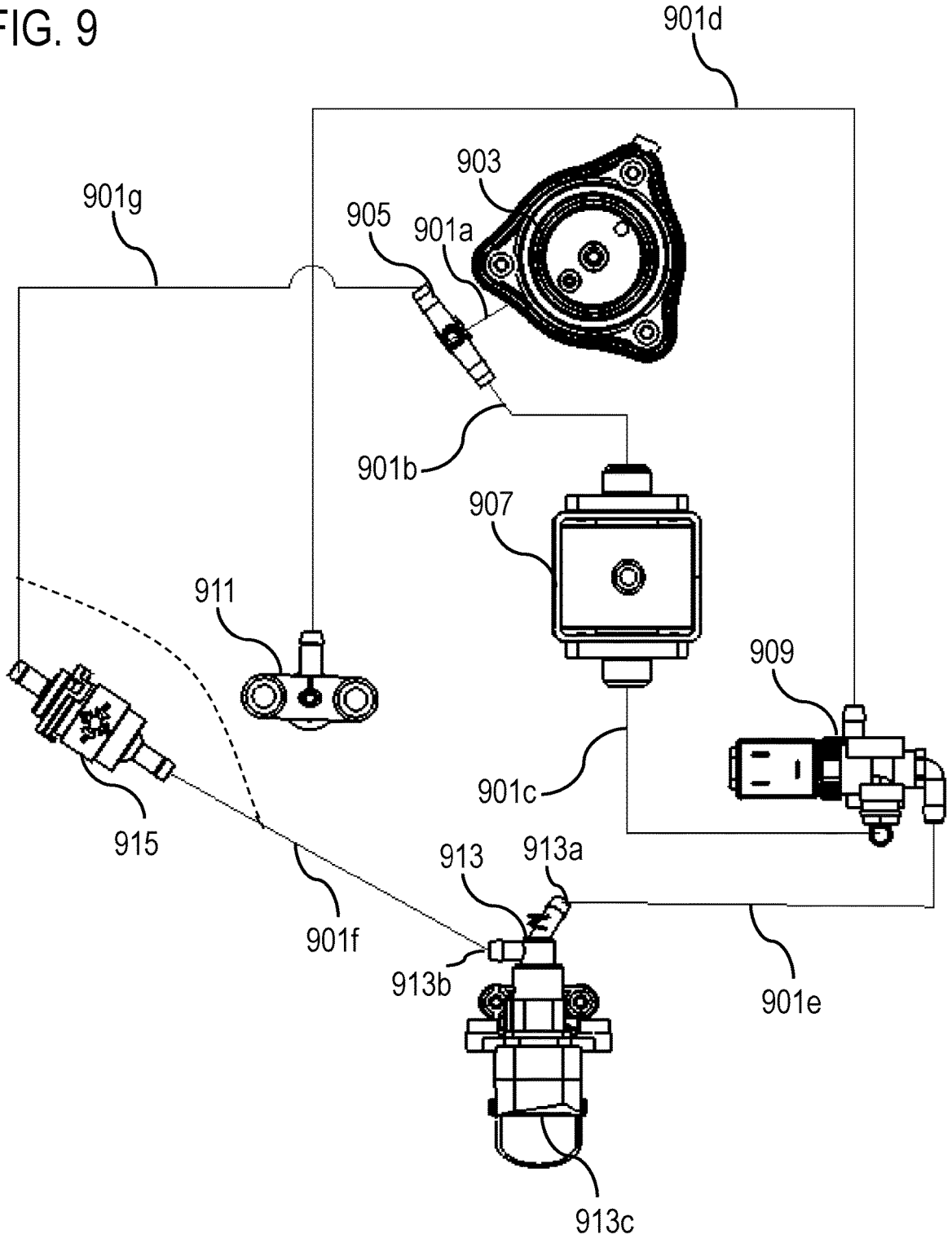
FIG. 9 is a diagram of a fluid flow system, in accordance with some embodiments.

FIG. 9 is a diagram of a fluid flow system 900, in accordance with some embodiments. Fluid flow system 900 includes a plurality of fluid flow paths 901*a*-901*g* that communicatively couple the tank fluid coupling, the fluid pump, the fluid diverter, the fluid output, and the accessory fluid coupling of body 201 (FIG. 2), or that are otherwise included in apparatus 100.

By way of example, fluid flow paths 901*a*-901*g* communicatively couple tank fluid coupling 903, three-way connector 905, fluid pump 907, fluid diverter 909, fluid output 911, accessory fluid coupling 913, and check valve 915. Each fluid flow path 901*a*-901*g* comprises one or more of a tube, a hose, a pipe, a nozzle, a valve, a fluid coupler, or some other suitable via through which fluid is capable of moving.

Fluid pump 907 is communicatively coupled with a controller of apparatus 100, such as controller 211 (FIG. 2) or controller 811 (FIG. 8). In use, fluid pump 907 causes cleaning fluid to be drawn from fluid flow path 901*b*. The cleaning fluid drawn from fluid flow path 901*b* comprises one or more of cleaning fluid directly drawn from cleaning fluid tank 105 (FIG. 1) by way of tank fluid coupling 903, fluid flow path 901*a*, and three-way connector 905, or cleaning fluid that was drawn from cleaning fluid tank 105, circulated through fluid flow paths 901*b*, 901*c*, 901*e*, 901*f* and 901*g*, and received by thee three-way connector 905.

The cleaning fluid drawn from cleaning fluid tank 105 is drawn into an inlet of fluid pump 907 and output to fluid flow path 901*c* from an outlet of fluid flow path 901*c*.

The fluid diverter 909 is communicatively coupled with the controller of apparatus 100. In a first operation state, the controller is configured to cause fluid diverter 917 to communicatively couple fluid flow path 901*c* and fluid flow path 901*d* such that the cleaning fluid output by fluid flow pump 907 is expelled from the fluid output 911. In a second operation state, the controller is configured to cause fluid diverter 917 to communicatively couple fluid flow path 901*c* with 901*e*. In some embodiments, the first operation state and the second operation state are detected by the controller based on a user input received by way of a switch such as switch 831 (FIG. 8), for example.

An inlet 913*a* of accessory fluid coupling 913 is communicatively coupled with fluid flow path 901*e*. A fluid system outlet 913*b* of accessory fluid coupling 913 is communicatively coupled with fluid flow path 901*f*. In use, if the accessory fluid coupling 913 is not coupled with an external accessory, the accessory fluid coupling 913 is configured to cause cleaning fluid to flow from fluid flow path 901*e* to fluid flow path 901*f*. If the accessory fluid coupling 913 is coupled with an external accessory, the accessory fluid coupling 913 is configured to allow cleaning fluid to flow out of an accessory fluid outlet 913*c* and into an accessory that is coupled with apparatus 100 by way of accessory fluid coupling 913.

An inlet of check valve 915 is communicatively coupled with the output of accessory fluid coupling 913 by way of fluid flow path 901*f*. An outlet of check valve 915 is communicatively coupled with three-way connector 905 by way of fluid flow path 901*g*. In use, if the accessory fluid coupling 913 is free from being coupled with an accessory, and the fluid diverter 909 is in the second operation state, cleaning fluid output by fluid pump 907 is caused to flow into fluid flow path 901*f*. If pressure builds in fluid flow path 901*f* to a point that a threshold pressure is breached, the check valve 915 will open to cause cleaning fluid to flow into fluid flow path 901*g*.

In some embodiments, if the accessory fluid coupling 913 is coupled with an accessory, check valve 915 is configured to allow pressure to build within fluid flow path 901*f* to a point that accessory fluid coupling 913 causes cleaning fluid to flow into an attached accessory by way of accessory fluid outlet 913*c*. If the attached accessory is in a state in which cleaning fluid is not being output by the accessory, pressure continues to build in fluid flow path 901*f* until the threshold pressure is reached. Upon reaching the threshold pressure with the accessory attached to the accessory fluid coupling, check valve 915 will open to cause cleaning fluid to flow into fluid flow path 901*g*.

Three-way connector 905 is configured to receive cleaning fluid from fluid flow path 901*a* and fluid flow path 901*g*. In some embodiments, three-way connector is configured to output fluid received from fluid flow path 901*a*, fluid flow path 901*g* or a mixture thereof to fluid flow path 901*b*. In some embodiments, three-way connector 905 is a valve. In some embodiments, three-way connector is reliant on pressure in fluid flow path 901*g* resulting from fluid pump 907, for example, or pressure in fluid flow path 901*a* caused by the relative height of the cleaning fluid in cleaning fluid tank 105 with respect to three-way connector 905, for example, to facilitate whether fluid pump 907 will receive cleaning fluid directly drawn from cleaning fluid tank 105, recirculated cleaning fluid that was drawn from cleaning fluid tank 105, or some combination thereof.

In some embodiments, check valve 915 is included in three-way connector 905, and fluid flow paths 901*f* and 901*g* are a continuous path free from having an intermediary component between accessory fluid coupling 913 and three-way connector 905.

In some embodiments, accessory fluid coupling 913 comprises a fluid diverter, valve or other suitable structure configured to direct fluid flow from the inlet 913*a* of accessory fluid coupling 913 to the accessory fluid output 913*c* based on the accessory fluid coupling being coupled with an accessory such that the flow of fluid into the attached accessory is free from being reliant on back pressure from check valve 915. In some embodiments, fluid pump 907 is configured to turn off if a fluid pressure in at least fluid flow path 901*c* is greater than a predetermined threshold.

Figure 10:
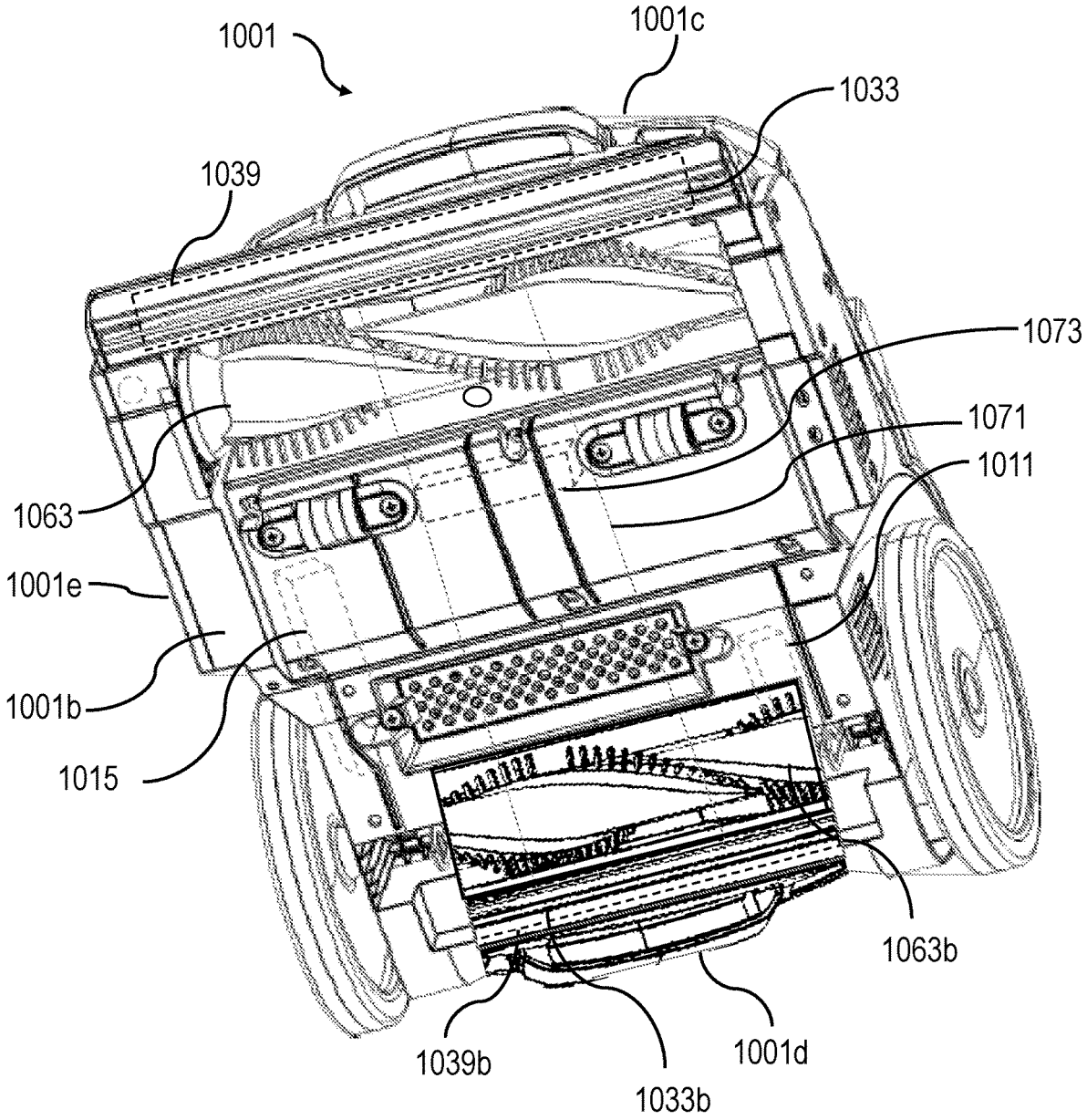
FIG. 10 is a perspective view of a body, in accordance with some embodiments.

FIG. 10 is a perspective view of a body 1001, in accordance with some embodiments.

Body 1001 is usable as body 101 (FIG. 1) of apparatus 100. Body 1001 is similar to body 201 (FIG. 2), with the reference numerals increased by 800. Some of the features that are similar to those discussed with respect to body 201 are omitted for clarity. In body 1001, the third air passage 1033 is on the lower side 1001*b* of the body 1001 between the front side 1001*c* and agitator 1063. Body 1001 includes another air passage 1033*b* on the lower side 1001*b* of body 1001 between the agitator 1063 and the back side 1001*d* of body 1001. The additional air passage 1033*b* is communicatively coupled with the recovery tank 107 by way of the nozzle flow path 1039 on the front side 1001*c* of body 1001 and a connector flow path 1071 coupled with another nozzle flow path 1039*b* on the back side 1001*d* of body 1001. In some embodiments, the additional air passage 1033*b* is communicatively coupled with the recovery tank 107 by nozzle flow path 1039*b* on the back side 1001*d* of body 1001 and the connector flow path 1071.

In some embodiments, the body 1001 comprises a recovery diverter 1073 communicatively coupled with the controller 1011 to cause air to flow through one of the third air passage 1033 or through the additional air passage 1033*b* to the recovery tank 107 based on a determined direction of movement of the body 1001. In some embodiments, recovery diverter 1073 is configured to open or close the connector flow path 1073. Recovery diverter comprises one or more of a motor, a movable panel, a closable vent, or some other suitable structure capable of opening and closing an air duct.

In some embodiments, body 1001 includes an additional agitator 1063*b*. The additional agitator 1063*b* is on the lower side 1001*b* of body 1001 between agitator 1063 and the additional air passage 1033*b*. The additional agitator 1063*b* is communicatively coupled with agitator motor 1015. Agitator motor 1015 is configured to cause the additional agitator 1063*b* to move based on an instruction output by the controller 1011. In some embodiments, the controller 1011 is configured to cause the additional agitator 1063*b* to rotate in the direction opposite to the direction of movement of the body 1001. In some embodiments, the controller 1011 is configured to cause the additional agitator 1063*b* to rotate in the same direction the body 1001 if the body 1001 is moving forward and in the direction opposite to the direction of movement of the body 1001 if the body 1001 is being pulled backward.

Figure 11:
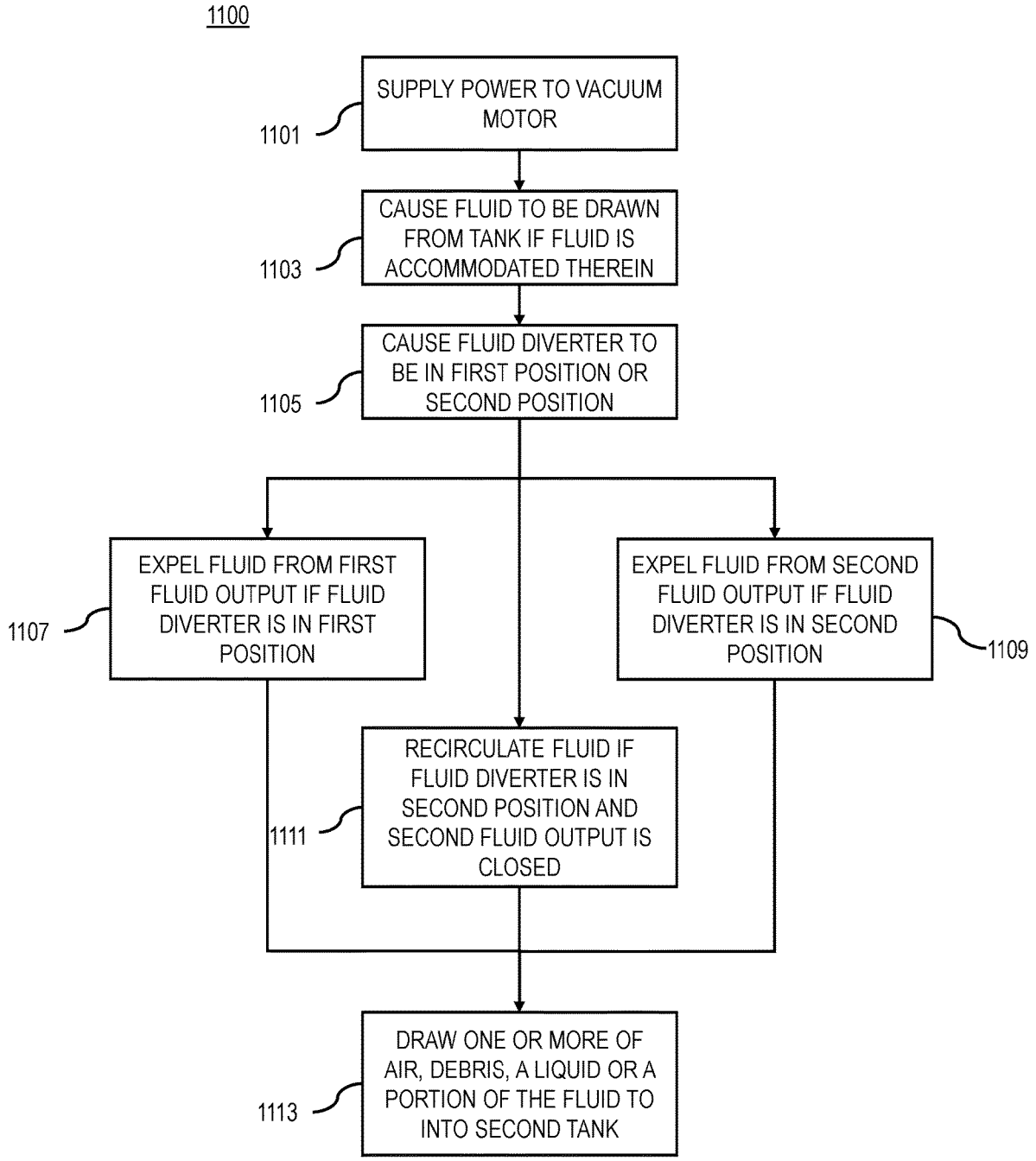
FIG. 11 is a flowchart of a method, in accordance with some embodiments.

FIG. 11 is a flowchart of a method 1100, in accordance with some embodiments. In some embodiments, one or more steps of method 1100 is implemented by apparatus 100 (FIG. 1) or a processor included in chipset 1200 (FIG. 12).

In step 1101, a controller causes power to be supplied to a vacuum motor based on a switch being in a first operation position or a second operation position.

In step 1103, a fluid accommodated by a first tank is drawn from the first tank based on the switch being in the first operation position or the second operation position. In some embodiments, a quantity of fluid accommodated within the first tank is detected based on an electrical connection between the controller and one or more of the fluid accommodated within the first tank or the first tank. In some embodiments, an indicator light is caused to turn on if the quantity of fluid accommodated in the first tank is less than a predetermined threshold value.

In step 1105, a fluid diverter communicatively coupled with the first tank is caused to be in a first position if the switch is in the first operation position or a second position if the switch is in the second operation position.

In step 1107, the fluid drawn from the first tank is expelled from a first fluid output communicatively coupled with the first tank by way of the fluid diverter based on an actuation of a fluid release input if the fluid diverter is in the first position. In some embodiments, an agitator motor communicatively coupled with the controller and configured to cause an agitator to move is activated if the switch is in the first operation position. In some embodiments, the controller causes the agitator motor to move the agitator if the switch is in the first position and the fluid release input is actuated. In some embodiments, the controller detects whether the agitator motor is capable of causing the agitator to move, for example is the agitator is jammed, while the agitator motor is activated and the switch is in the first operation position. If the agitator is incapable of moving, the controller causes one or more of the agitator motor, the vacuum motor or a fluid pump that draws the fluid from the first tank to be inactivated while the switch is in the first operation position. In some embodiments, the controller causes an indicator light to turn on based on the detection that the agitator motor is incapable of causing the agitator to move.

In step 1109 the fluid drawn from the first tank is expelled from a second fluid output communicatively coupled with the first tank by way of the fluid diverter if the second fluid output is open. In some embodiments, the second fluid output is closed unless a fluid coupling is attached to the second fluid output. In some embodiments, power is supplied to an electrical contact associated with the second fluid output based on a determination the fluid coupling is attached to the second fluid output.

In step 1111, fluid drawn from the first tank is recirculated to a first tank side of the fluid diverter if the fluid diverter is in the second position and the second fluid output is closed.

In step 1113 the vacuum motor causes one or more of air, debris, a liquid or a portion of the fluid to be drawn into a second tank separate from the first tank.

FIG. 12 is a functional block diagram of a computer or processor-based system 1200 upon which or by which an embodiment is implemented.

Processor-based system 1200 is programmed to cause a fluid extraction system such as apparatus 100 to operate as described herein, and includes, for example, bus 1201, processor 1203, and memory 1205 components.

In some embodiments, the processor-based system 1200 is implemented as a single "system on a chip." Processor-based system 1200, or a portion thereof, constitutes a mechanism for performing one or more steps of operating a liquid extraction system.

In some embodiments, the processor-based system 1200 includes a communication mechanism such as bus 1201 for transferring information and/or instructions among the components of the processor-based system 1200. Processor 1203 is connected to the bus 1201 to obtain instructions for execution and process information stored in, for example, the memory 1205. In some embodiments, the processor 1203 is also accompanied with one or more specialized components to perform certain processing functions and tasks such as one or more digital signal processors (DSP), or one or more application-specific integrated circuits (ASIC). A DSP typically is configured to process real-world signals (e.g., sound) in real time independently of the processor 1203. Similarly, an ASIC is configurable to perform specialized functions not easily performed by a more general purpose processor. Other specialized components to aid in performing the functions described herein optionally include one or more field programmable gate arrays (FPGA), one or more controllers, or one or more other special-purpose computer chips.

In one or more embodiments, the processor (or multiple processors) 1203 performs a set of operations on information as specified by a set of instructions stored in memory 1205 related to operating a liquid extraction system. The execution of the instructions causes the processor to perform specified functions.

The processor 1203 and accompanying components are connected to the memory 1205 via the bus 1201. The memory 1205 includes one or more of dynamic memory (e.g., RAM, magnetic disk, writable optical disk, etc.) and static memory (e.g., ROM, CD-ROM, etc.) for storing executable instructions that when executed perform the steps described herein to operate a liquid extraction system. The memory 1205 also stores the data associated with or generated by the execution of the steps.

In one or more embodiments, the memory 1205, such as a random access memory (RAM) or any other dynamic storage device, stores information including processor instructions for operating a liquid extraction system. Dynamic memory allows information stored therein to be changed by system 1200. RAM allows a unit of information stored at a location called a memory address to be stored and retrieved independently of information at neighboring addresses. The memory 1205 is also used by the processor 1203 to store temporary values during execution of processor instructions. In various embodiments, the memory 1205 is a read only memory (ROM) or any other static storage device coupled to the bus 1201 for storing static information, including instructions, that is not changed by the system 1200. Some memory is composed of volatile storage that loses the information stored thereon when power is lost. In some embodiments, the memory 1205 is a non-volatile (persistent) storage device, such as a magnetic disk, optical disk or flash card, for storing information, including instructions, that persists even when the system 1200 is turned off or otherwise loses power.

The term "computer-readable medium" as used herein refers to any medium that participates in providing information to processor 1203, including instructions for execution. Such a medium takes many forms, including, but not limited to computer-readable storage medium (e.g., non-volatile media, volatile media). Non-volatile media includes, for example, optical or magnetic disks. Volatile media include, for example, dynamic memory. Common forms of computer-readable media include, for example, a floppy disk, a flexible disk, a hard disk, a magnetic tape, another magnetic medium, a CD-ROM, CDRW, DVD, another optical medium, punch cards, paper tape, optical mark sheets, another physical medium with patterns of holes or other optically recognizable indicia, a RAM, a PROM, an EPROM, a FLASH-EPROM, an EEPROM, a flash memory, another memory chip or cartridge, or another medium from which a computer can read. The term computer-readable storage medium is used herein to refer to a computer-readable medium.

An aspect of this description is related to an apparatus comprising a body, a first tank and a second tank. The body comprises a first fluid coupling and a first air passage. The first tank comprises a first vessel configured to accommodate a fluid and a second fluid coupling communicatively coupled with the first fluid coupling. The second tank comprises a second vessel separated from the first vessel and a second air passage communicatively coupled with the first air passage. The apparatus also comprises a tank base over the body. The tank base comprises a first tank seat configured to accommodate the first tank and a second tank seat configured to accommodate the second tank. The tank base is configured to be separated from the body with at least one of the first tank in the first tank seat or the second tank in the second tank seat.

Another aspect of this description is directed to method comprising causing, by a controller, power to be supplied to a vacuum motor based on a switch being in a first operation position or a second operation position. The method also comprises causing a fluid accommodated by a first tank to be drawn from the first tank based on the switch being in the first operation position or the second operation position. The method further comprises causing a fluid diverter communicatively coupled with the first tank to be in a first position if the switch is in the first operation position or a second position if the switch is in the second operation position. The method additionally comprises causing (1) the fluid drawn from the first tank to be expelled from a first fluid output communicatively coupled with the first tank by way of the fluid diverter based on an actuation of a fluid release input if the fluid diverter is in the first position, (2) the fluid drawn from the first tank to be expelled from a second fluid output communicatively coupled with the first tank by way of the fluid diverter if the second fluid output is open, or (3) the fluid drawn from the first tank to be recirculated to a first tank side of the fluid diverter if the fluid diverter is in the second position and the second fluid output is closed. The vacuum motor causes one or more of air, debris, a liquid or a portion of the fluid to be drawn into a second tank separate from the first tank.

A further aspect of this description is directed to an apparatus, comprising a body comprising a first fluid coupling, a first air passage, an agitator housing, and a fluid output communicatively coupled with the first fluid coupling. The apparatus also comprises a first tank comprising a first vessel configured to accommodate a fluid, and a second fluid coupling communicatively coupled with the first fluid coupling. The apparatus further comprises a second tank comprising a second vessel separated from the first vessel, and a second air passage communicatively coupled with the first air passage. The apparatus additionally comprises a tank base over the body. The tank base comprises a first tank seat configured to accommodate the first tank, and a second tank seat configured to accommodate the second tank. The tank base is configured to be separated from the body with at least one of the first tank or the second tank, or independent from the first tank and the second tank. The apparatus also comprises a vacuum motor having an inlet communicatively coupled with the first air passage by way of the second tank. The apparatus further comprises a fluid pump communicatively coupled with the first fluid coupling and the fluid output. The apparatus additionally comprises an agitator in the agitator housing. The apparatus also comprises an agitator motor configured to cause the agitator to move. The apparatus further comprises a handle coupled with the body. The handle comprises a first end coupled with the body and a second end opposite the first end having a grip portion. The grip portion has an under-grip side facing a direction toward the first end of the handle and an over-grip side facing a direction away from the first end of the handle. The handle also comprises a switch on the under-grip side of the grip portion. The apparatus additionally comprises a controller communicatively coupled with the vacuum motor, the fluid pump, the agitator motor and the user input. The controller is configured to activate the fluid pump to cause fluid contained in the first tank to be ejected from the fluid output and to activate the agitator motor to cause the agitator to move based on a position of the switch, and to activate the vacuum motor to draw one or more of air, debris, a liquid or a portion of the fluid into the second tank in an on state.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure. As such, although features of several embodiments are expressed in certain combinations among the foregoing description and claims, the features or steps discussed with respect to some embodiments can be arranged in any combination or order.

What is claimed is:

1. An apparatus, comprising:

a body comprising:
- a first fluid coupling; and
- a first air passage;

a first tank comprising:
- a first vessel configured to accommodate a fluid; and
- a second fluid coupling communicatively coupled with the first fluid coupling;

a second tank comprising:
- a second vessel separated from the first vessel; and
- a second air passage communicatively coupled with the first air passage; and a tank base over the body, the tank base comprising:
- a first tank seat configured to accommodate the first tank;
- a second tank seat configured to accommodate the second tank;
- a first locking mechanism configured to secure the first tank in the first tank seat;
- a second locking mechanism configured to secure the second tank in the second tank seat;
- a first button to release the first locking mechanism; and
- a second button to release the second locking mechanism, wherein the tank base is configured to be separated from the body with at least one of the first tank in the first tank seat or the second tank in the second tank seat, and the tank base is configured to be removably attached to the body with the first tank secured in the first tank seat, the second tank secured in the second tank seat, the first tank secured in the first tank seat and the second tank secured in the second tank seat, or free from having either of the first tank secured in the first tank seat or the second tank secured in the second tank seat.

2. The apparatus of claim 1, wherein the tank base is configured to one or more of cause the second fluid coupling to be substantially aligned with the first fluid coupling or cause the second air passage to be substantially aligned with the first air passage if the first tank is in the first tank seat or the second tank is in the second tank seat, and the tank base is over the body.

3. The apparatus of claim 1, wherein the tank base further comprises:

a first support member having the first tank seat and the second tank seat;

a second support member over the first support member; and a third locking mechanism configured to selectively secure the first support member to the body, wherein the second support member comprises the first button and the second button.

4. The apparatus of claim 1, further comprising:

a handle coupled with the body, the handle comprising:
- a first portion coupled with the body and configured to rotate about a first axis with respect to the body; and
- a second portion coupled with the first portion and configured to rotate about a second axis with respect to the first portion.

5. The apparatus of claim 1, wherein the body further comprises a fluid output, and the apparatus further comprises:

a vacuum motor having an inlet communicatively coupled with the first air passage by way of the second tank;

a fluid pump communicatively coupled with the first fluid coupling and the fluid output; and a controller communicatively coupled with the vacuum motor and the fluid pump, the controller being configured to activate the fluid pump to cause fluid contained in the first tank to be ejected from the fluid output, and to activate the vacuum motor to draw one or more of air, debris, a liquid or a portion of the fluid into the second tank.

6. The apparatus of claim 5, wherein the body further comprises an accessory connection receptacle having a third fluid coupling and an electrical contact, the third fluid coupling is communicatively coupled with the first fluid coupling, the electrical contact is communicatively coupled with the controller, the accessory connection receptacle is configured to accommodate a correspondingly shaped structure configured to mate with the accessory connection receptacle and be communicatively coupled with the third fluid coupling and with the electrical contact.

7. The apparatus of claim 6, further comprising:

a fluid diverter communicatively coupled with the controller, and communicatively coupled between the first fluid coupling, the fluid output and the third fluid coupling, wherein the controller is configured to cause the fluid diverter to be in one of a first operation position in which the fluid diverter is configured to cause fluid drawn from the first tank to be ejected from the fluid output, or in a second operation position in which the fluid diverter is configured to cause fluid drawn from the first tank to be ejected from the third fluid coupling, the controller is configured to cause the fluid diverter to be in the first operation position or the second operation position based on a selected operating state of the apparatus, and one or more of the controller or the third fluid coupling is configured to prevent fluid drawn from the first tank to be ejected from the third fluid coupling unless the correspondingly shaped structure is in the accessory connection receptacle, the third fluid coupling is communicatively coupled with the correspondingly shaped structure, and the fluid diverter is in the second operation position based on the selected operating state of the apparatus.

8. The apparatus of claim 5, wherein the body further comprises an electrical contact in the first fluid coupling, the controller is communicatively coupled with the electrical contact, and the controller is configured to detect a volume of fluid contained in the first tank based on a capacitance in the first tank.

9. The apparatus of claim 1, wherein the second tank further comprises a flow path extending from the second air passage into the second vessel and a diverter at an end of the flow path, internal to the second vessel, and the diverter is configured to change a direction of flow of the air, debris, liquid or portion of the fluid drawn into the second vessel by way of the flow path.

10. An apparatus, comprising:

a body comprising:

a first fluid coupling;

a first air passage;

an agitator housing; and a fluid output communicatively coupled with the first fluid coupling;

a first tank comprising:

a first vessel configured to accommodate a fluid; and a second fluid coupling communicatively coupled with the first fluid coupling;

a second tank comprising:

a second vessel separated from the first vessel; and a second air passage communicatively coupled with the first air passage;

a tank base over the body, the tank base comprising:

a first tank seat configured to accommodate the first tank; and a second tank seat configured to accommodate the second tank, the tank base being configured to be separated from the body with at least one of the first tank or the second tank, or independent from the first tank and the second tank;

a vacuum motor having an inlet communicatively coupled with the first air passage by way of the second tank;

a fluid pump communicatively coupled with the first fluid coupling and the fluid output;

an agitator in the agitator housing;

an agitator motor configured to cause the agitator to move;

a handle coupled with the body, the handle comprising:

a first end coupled with the body;

a second end opposite the first end having a grip portion, the grip portion having an under-grip side facing a direction toward the first end and an over-grip side facing a direction away from the first end; and a switch on the under-grip side of the grip portion; and a controller communicatively coupled with the vacuum motor, the fluid pump, the agitator motor and the user input, the controller being configured to activate the fluid pump to cause fluid contained in the first tank to be ejected from the fluid output and to activate the agitator motor to cause the agitator to move based on a position of the switch, and to activate the vacuum motor to draw one or more of air, debris, a liquid or a portion of the fluid into the second tank in an on state.

11. The apparatus of claim 10, wherein the tank base is configured to one or more of cause the second fluid coupling to be substantially aligned with the first fluid coupling or cause the second air passage to be substantially aligned with the first air passage if the first tank is in the first tank seat or the second tank is in the second tank seat, and the tank base is over the body.

12. The apparatus of claim 10, wherein the tank base is configured to be removably attached to the body with the first tank secured in the first tank seat, the second tank secured in the second tank seat, the first tank secured in the first tank seat and the second tank secured in the second tank seat, or free from having either of the first take secured in the first tank seat or the second tank secured in the second tank seat.

13. The apparatus of claim 12, wherein the tank base further comprises:

a first locking mechanism configured to secure the first tank in the first tank seat;

a second locking mechanism configured to secure the second tank in the second tank seat;

a first button to release the first locking mechanism; and a second button to release the second locking mechanism.

14. The apparatus of claim 10, wherein the body comprises the vacuum motor.

15. The apparatus of claim 10, wherein the body further comprises an accessory connection receptacle having a third fluid coupling and an electrical contact, the third fluid coupling is communicatively coupled with the first fluid coupling, the electrical contact is communicatively coupled with the controller, the accessory connection receptacle is configured to accommodate a correspondingly shaped structure configured to mate with the accessory connection receptacle and be communicatively coupled with the third fluid coupling and with the electrical contact.

16. The apparatus of claim 15, further comprising:

a fluid diverter communicatively coupled with the controller, and communicatively coupled between the first fluid coupling, the fluid output and the third fluid coupling, wherein the controller is configured to cause the fluid diverter to be in one of a first operation position in which the fluid diverter is configured to cause fluid drawn from the first tank to be ejected from the fluid output, or in a second operation position in which the fluid diverter is configured to cause fluid drawn from the first tank to be ejected from the third fluid coupling, the controller is configured to cause the fluid diverter to be in the first operation position or the second operation position based on a selected operating state of the apparatus, and one or more of the controller or the third fluid coupling is configured to prevent fluid drawn from the first tank to be ejected from the third fluid coupling unless the correspondingly shaped structure is in the accessory connection receptacle, the third fluid coupling is communicatively coupled with the correspondingly shaped structure, and the fluid diverter is in the second operation position based on the selected operating state of the apparatus.

17. The apparatus of claim 10, wherein the body further comprises an electrical contact in the first fluid coupling, the controller is communicatively coupled with the electrical contact, and the controller is configured to detect a volume of fluid contained in the first tank based on a capacitance in the first tank.

18. The apparatus of claim 10, wherein the second tank further comprises a flow path extending from the second air passage into the second vessel and a diverter at an end of the flow path, internal to the second vessel, and the diverter is configured to change a direction of flow of the air, debris, liquid or portion of the fluid drawn into the second vessel by way of the flow path.

19. An apparatus, comprising:

a body comprising:

a first fluid coupling; and a first air passage;

a first tank comprising:

a first vessel configured to accommodate a fluid; and a second fluid coupling communicatively coupled with the first fluid coupling;

a second tank comprising:

a second vessel separated from the first vessel;

a second air passage communicatively coupled with the first air passage; and a flow path extending from the second air passage into the second vessel and a diverter at an end of the flow path, internal to the second vessel, the diverter being configured to change a direction of flow of the air, debris, liquid or portion of the fluid drawn into the second vessel by way of the flow path; and a tank base over the body, the tank base comprising:

a first tank seat configured to accommodate the first tank; and a second tank seat configured to accommodate the second tank, wherein the tank base is configured to be separated from the body with at least one of the first tank in the first tank seat or the second tank in the second tank seat.

20. The apparatus of claim 19, wherein the body further comprises a vacuum motor, the tank base further comprises:

a first locking mechanism configured to secure the first tank in the first tank seat; and a second locking mechanism configured to secure the second tank in the second tank seat, and the tank base is configured to be removably attached to the body with the first tank secured in the first tank seat, the second tank secured in the second tank seat, the first tank secured in the first tank seat and the second tank secured in the second tank seat, or free from having either of the first tank secured in the first tank seat or the second tank secured in the second tank seat.

* * * * *